US008663547B2

(12) United States Patent
Crafton et al.

(10) Patent No.: US 8,663,547 B2
(45) Date of Patent: Mar. 4, 2014

(54) HIGH PRESSURE HEAT TREATMENT SYSTEM

(75) Inventors: Scott P. Crafton, Marietta, GA (US); Paul M. Crafton, Kennesaw, GA (US); Ian French, Kennesaw, GA (US); Shanker Subramanian, Marietta, GA (US)

(73) Assignee: Consolidated Engineering Company, Inc., Kennesaw, GA (US)

( * ) Notice: Subject to any disclaimer, the term of this patent is extended or adjusted under 35 U.S.C. 154(b) by 0 days.

(21) Appl. No.: 13/462,076

(22) Filed: May 2, 2012

(65) Prior Publication Data

US 2012/0211191 A1 Aug. 23, 2012

Related U.S. Application Data

(63) Continuation of application No. 12/393,099, filed on Feb. 26, 2009, now abandoned, which is a continuation of application No. 11/261,263, filed on Oct. 28, 2005, now abandoned.

(60) Provisional application No. 60/623,716, filed on Oct. 29, 2004, provisional application No. 60/667,230, filed on Apr. 1, 2005.

(51) Int. Cl.
*B22D 25/06* (2006.01)

(52) U.S. Cl.
USPC ..... 266/259; 164/76.1

(58) Field of Classification Search
USPC ..... 266/259, 87; 164/76.1
See application file for complete search history.

(56) References Cited

U.S. PATENT DOCUMENTS

| | | | | |
|---|---|---|---|---|
| 2,385,962 | A | 10/1945 | Barnett | 34/13 |
| 2,813,318 | A | 11/1957 | Horth | 22/89 |
| 2,988,351 | A | 6/1961 | Barnett et al. | 263/40 |
| 3,194,545 | A | 7/1965 | Smith | 266/3 |
| 3,222,227 | A | 12/1965 | Baugh et al. | 148/11.5 |
| 3,351,687 | A | 11/1967 | Thome et al. | 432/133 |
| 3,432,368 | A | 3/1969 | Nakamura | 148/12 |
| 3,534,946 | A | 10/1970 | Westerkamp et al. | 263/28 |
| 3,604,695 | A | 9/1971 | Steeper | 266/5 T |
| 3,675,905 | A | 7/1972 | Placek | 263/2 |
| 3,737,280 | A | 6/1973 | Cromp | 432/14 |
| 3,760,800 | A | 9/1973 | Staffin et al. | 128/24.1 |
| 3,794,232 | A | 2/1974 | Petri | 226/50 |
| 3,856,583 | A | 12/1974 | Sanders et al. | 148/159 |

(Continued)

FOREIGN PATENT DOCUMENTS

| | | | |
|---|---|---|---|
| CA | 1197981 | 12/1985 | B01J 8/18 |
| DE | 1 030 974 | 9/1955 | |

(Continued)

OTHER PUBLICATIONS

Economical Used Energy Type Continuing Heat Treating Furnace for Aluminum Castings Dogyo—Kanetsu vol. 21 No. 2 pp. 29-36—Mar. 1984.

(Continued)

*Primary Examiner* — Scott Kastler
(74) *Attorney, Agent, or Firm* — Womble Carlyle Sandridge & Rice LLP

(57) ABSTRACT

A furnace for heat treating a metal workpiece is provided. A method and system for processing a workpiece also are provided.

8 Claims, 15 Drawing Sheets

(56) References Cited

U.S. PATENT DOCUMENTS

| | | | | |
|---|---|---|---|---|
| 3,871,438 | A | 3/1975 | Vissers et al. | 164/5 |
| 3,971,111 | A | 7/1976 | Ballini et al. | 29/38 C |
| 3,977,911 | A | 8/1976 | Takase | 148/538 |
| 3,993,420 | A | 11/1976 | Haas et al. | 425/127 |
| 3,996,412 | A | 12/1976 | Schaefer et al. | 13/20 |
| 4,021,272 | A | 5/1977 | Asai et al. | 148/15 |
| 4,027,862 | A | 6/1977 | Schaefer et al. | 266/160 |
| 4,068,389 | A | 1/1978 | Staffin et al. | 34/57 A |
| 4,098,624 | A | 7/1978 | Laird, Jr. | 148/153 |
| 4,140,467 | A | 2/1979 | Ellison et al. | 432/72 |
| 4,153,236 | A | 5/1979 | Elhaus | 266/252 |
| 4,161,389 | A | 7/1979 | Staffin et al. | 432/58 |
| 4,177,085 | A | 12/1979 | Chadwick et al. | 148/2 |
| 4,177,952 | A | 12/1979 | Rikker | 241/40 |
| 4,211,274 | A | 7/1980 | Slowinski et al. | 164/401 |
| 4,242,077 | A | 12/1980 | Hyre | 31/19 |
| 4,255,133 | A | 3/1981 | Tanifuji et al. | 432/24 |
| 4,257,767 | A | 3/1981 | Price | 432/24 |
| 4,294,436 | A | 10/1981 | Takahashi | 266/257 |
| 4,325,424 | A | 4/1982 | Scheffer | 164/5 |
| 4,336,076 | A | 6/1982 | Edamura et al. | 148/549 |
| 4,338,077 | A | 7/1982 | Shibayama et al. | 432/11 |
| 4,340,433 | A | 7/1982 | Harding | 148/16 |
| 4,357,135 | A | 11/1982 | Wilde et al. | 432/11 |
| 4,392,814 | A | 7/1983 | Harding | 431/170 |
| 4,411,709 | A | 10/1983 | Nakanishi | 148/3 |
| 4,415,444 | A | 11/1983 | Guptail | 209/3 |
| 4,419,143 | A | 12/1983 | Ito et al. | 148/3 |
| 4,420,345 | A | 12/1983 | Ito et al. | 148/3 |
| 4,427,375 | A | 1/1984 | Di Rosa | 432/58 |
| 4,457,352 | A | 7/1984 | Scheffer | 164/5 |
| 4,457,788 | A | 7/1984 | Staffin et al. | 148/20.3 |
| 4,457,789 | A | 7/1984 | Wilks | 148/134 |
| 4,478,572 | A | 10/1984 | Selli | 432/13 |
| 4,490,107 | A | 12/1984 | Kimura et al. | 422/11 |
| 4,499,940 | A | 2/1985 | Hall | 64/36 |
| 4,512,821 | A | 4/1985 | Staffin et al. | 148/16.5 |
| 4,519,718 | A | 5/1985 | Staffin et al. | 374/45 |
| 4,524,957 | A | 6/1985 | Staffin et al. | 266/252 |
| 4,544,013 | A | 10/1985 | Kearney et al. | 164/5 |
| 4,547,228 | A | 10/1985 | Girrell et al. | 148/16 |
| 4,577,671 | A | 3/1986 | Stephan | 164/401 |
| 4,579,319 | A | 4/1986 | Sasaki | 266/252 |
| 4,582,301 | A | 4/1986 | Wunning | 266/87 |
| 4,604,055 | A | 8/1986 | Mackenzie | 432/58 |
| 4,606,529 | A | 8/1986 | Tooch | 266/80 |
| 4,613,713 | A | 9/1986 | Staffin et al. | 585/241 |
| 4,620,586 | A | 11/1986 | Musschoot | 164/253 |
| 4,620,884 | A | 11/1986 | Heath | 148/128 |
| 4,623,400 | A | 11/1986 | Japka et al. | 148/6.35 |
| 4,627,814 | A | 12/1986 | Hattori et al. | 432/128 |
| 4,648,836 | A | 3/1987 | Thom | 32/107 |
| 4,671,337 | A | 6/1987 | Kawai et al. | 164/151.2 |
| 4,671,496 | A | 6/1987 | Girrell et al. | 266/78 |
| 4,681,267 | A | 7/1987 | Leidel et al. | 241/23 |
| 4,700,766 | A | 10/1987 | Godderidge | 164/5 |
| 4,738,615 | A | 4/1988 | Bailey et al. | 432/15 |
| 4,752,061 | A | 6/1988 | Dalton et al. | 266/87 |
| 4,779,163 | A | 10/1988 | Bickford et al. | 361/212 |
| 4,802,525 | A | 2/1989 | Heine et al. | 432/128 |
| 4,817,920 | A | 4/1989 | Erfort, Jr. | 266/252 |
| 4,830,605 | A | 5/1989 | Hodate et al. | 431/170 |
| 4,832,764 | A | 5/1989 | Merz | 48/131 |
| 4,878,952 | A | 11/1989 | Pillhoefer | 148/1 |
| 4,955,425 | A | 9/1990 | McKenna | 164/269 |
| 5,018,707 | A | 5/1991 | Hemsath et al. | 266/254 |
| 5,052,923 | A | 10/1991 | Peter et al. | 432/207 |
| 5,071,487 | A | 12/1991 | McKibben et al. | 134/22.18 |
| 5,108,519 | A | 4/1992 | Armanie et al. | 148/12.7 A |
| 5,108,520 | A | 4/1992 | Liu et al. | 148/12.7 R |
| 5,115,770 | A | 5/1992 | Yen et al. | 123/193.6 |
| 5,120,372 | A | 6/1992 | Yen et al. | 420/537 |
| 5,156,800 | A | 10/1992 | Buchet et al. | 266/99 |
| 5,169,913 | A | 12/1992 | Staffin et al. | 526/65 |
| 5,178,695 | A | 1/1993 | LaSalle et al. | 148/698 |
| 5,226,983 | A | 7/1993 | Skinner et al. | 148/549 |
| 5,239,917 | A | 8/1993 | Lutkie et al. | 99/443 C |
| 5,251,683 | A | 10/1993 | Backer | 164/98 |
| 5,253,698 | A | 10/1993 | Keough et al. | 164/269 |
| 5,263,652 | A | 11/1993 | Iwanami et al. | 241/57 |
| 5,294,094 | A | 3/1994 | Crafton et al. | 266/44 |
| 5,306,359 | A | 4/1994 | Eppeland et al. | 148/511 |
| 5,308,410 | A | 5/1994 | Hurimura et al. | 148/561 |
| 5,312,498 | A | 5/1994 | Anderson | 148/511 |
| 5,327,955 | A | 7/1994 | Easwaran | 164/516 |
| 5,336,344 | A | 8/1994 | Wei | 8/549 |
| 5,340,089 | A | 8/1994 | Heath et al. | 266/87 |
| 5,340,418 | A | 8/1994 | Wei | 148/549 |
| 5,350,160 | A | 9/1994 | Crafton et al. | 266/252 |
| 5,354,038 | A | 10/1994 | Crafton | 266/44 |
| 5,378,434 | A | 1/1995 | Staffin et al. | 422/141 |
| 5,423,370 | A | 6/1995 | Bonnemasou et al. | 164/132 |
| 5,439,045 | A | 8/1995 | Crafton | 164/5 |
| 5,443,383 | A | 8/1995 | Kuehn | 432/128 |
| 5,449,422 | A | 9/1995 | Pflanz et al. | 148/601 |
| 5,477,906 | A | 12/1995 | Legge et al. | 164/122.1 |
| 5,485,985 | A | 1/1996 | Eppeland et al. | 266/87 |
| 5,514,228 | A | 5/1996 | Wyatt-Mair et al. | 148/551 |
| 5,518,557 | A | 5/1996 | Jones et al. | 148/511 |
| 5,531,423 | A | 7/1996 | Crafton et al. | 266/44 |
| 5,533,562 | A | 7/1996 | Moschini et al. | 164/71.1 |
| 5,536,337 | A | 7/1996 | Wei | 148/549 |
| 5,547,523 | A | 8/1996 | Blankenship, Jr. et al. | 148/677 |
| 5,551,670 | A | 9/1996 | Heath et al. | 266/87 |
| 5,551,998 | A | 9/1996 | Crafton et al. | 148/538 |
| 5,565,046 | A | 10/1996 | Crafton et al. | 148/538 |
| 5,571,347 | A | 11/1996 | Bergsma | 148/550 |
| 5,593,519 | A | 1/1997 | Blankenship, Jr. et al. | 148/514 |
| 5,643,372 | A | 7/1997 | Sainfort et al. | 148/699 |
| 5,732,762 | A | 3/1998 | Usui et al. | 164/270.1 |
| 5,738,162 | A | 4/1998 | Crafton | 164/5 |
| 5,829,509 | A | 11/1998 | Crafton | 164/5 |
| 5,850,866 | A | 12/1998 | Crafton | 164/5 |
| 5,901,775 | A | 5/1999 | Musschoot et al. | 164/404 |
| 5,924,470 | A | 7/1999 | Costilla-Vela et al. | 164/4.1 |
| 5,957,188 | A | 9/1999 | Crafton | 164/5 |
| 6,033,497 | A | 3/2000 | Ryan et al. | 148/325 |
| 6,042,369 | A | 3/2000 | Bergman et al. | 432/15 |
| 6,112,803 | A | 9/2000 | Kruger | 164/103 |
| 6,217,317 | B1 | 4/2001 | Crafton et al. | 432/128 |
| 6,241,000 | B1 | 6/2001 | Conroy et al. | 164/132 |
| 6,253,830 | B1 | 7/2001 | Bickford et al. | 164/132 |
| 6,325,873 | B1 | 12/2001 | Pollkoetter | 148/552 |
| 6,336,809 | B1 | 1/2002 | Crafton et al. | 432/207 |
| 6,457,425 | B1 | 10/2002 | Crafton et al. | 110/346 |
| 6,467,529 | B2 | 10/2002 | Kay | 4/131 |
| 6,547,556 | B2 | 4/2003 | Crafton et al. | 164/131 |
| 6,588,487 | B2 | 7/2003 | Crafton et al. | 164/127 |
| 6,622,775 | B2 | 9/2003 | Crafton et al. | 164/131 |
| 6,672,367 | B2 | 1/2004 | Crafton et al. | 164/5 |
| 6,884,966 | B2 | 4/2005 | Coleman et al. | 219/243 |
| 6,901,990 | B2 | 6/2005 | Howard et al. | 164/76.1 |
| 6,910,522 | B2 | 6/2005 | Crafton et al. | 164/404 |
| 7,047,894 | B2 | 5/2006 | Crafton et al. | 110/346 |
| 7,252,134 | B2 | 8/2007 | Crafton et al. | 164/70.1 |
| 7,258,755 | B2 | 8/2007 | Crafton et al. | 148/540 |
| 7,275,582 | B2 | 10/2007 | Crafton et al. | 164/122 |
| 7,290,583 | B2 | 11/2007 | Crafton et al. | 164/131 |
| 7,331,374 | B2 | 2/2008 | Lewis, Jr. et al. | 164/131 |
| 7,338,629 | B2 | 3/2008 | Crafton et al. | 266/87 |
| 2002/0104596 | A1 | 8/2002 | Crafton et al. | 148/538 |
| 2004/0035546 | A1 | 2/2004 | DiSerio | 164/76.1 |
| 2004/0055728 | A1 | 3/2004 | Lewis, Jr. et al. | 164/131 |
| 2004/0123786 | A1 | 7/2004 | Crafton et al. | 110/346 |
| 2005/0072549 | A1 | 4/2005 | Crafton et al. | 164/122 |
| 2005/0145362 | A1 | 7/2005 | Crafton et al. | 164/131 |
| 2005/0205228 | A1 | 9/2005 | Crafton et al. | 164/5 |
| 2005/0257858 | A1 | 11/2005 | Crafton et al. | 148/540 |
| 2005/0269751 | A1 | 12/2005 | Crafton et al. | 266/87 |

(56) References Cited

U.S. PATENT DOCUMENTS

| | | | | |
|---|---|---|---|---|
| 2006/0000571 | A1 | 1/2006 | Crafton et al. | 164/70.1 |
| 2012/0211191 | A1* | 8/2012 | Crafton et al. | 164/76.1 |

FOREIGN PATENT DOCUMENTS

| | | | | |
|---|---|---|---|---|
| DE | 2307773 | | 2/1973 | B22D 5/02 |
| DE | 2323805 | | 5/1973 | F27B 9/10 |
| DE | 2310541 | | 9/1973 | |
| DE | 2315958 | | 4/1974 | F23G 7/06 |
| DE | 2337894 | | 11/1974 | B08B 7/04 |
| DE | 2914221 | | 4/1979 | B22C 5/00 |
| DE | 3206048 | | 2/1982 | B22D 21/04 |
| DE | 3215809 | | 4/1982 | B22D 29/00 |
| DE | 4012158 | | 11/1990 | |
| DE | 42 08 485 | | 2/1993 | C21D 1/613 |
| DE | 195 30 975 | | 2/1997 | B22C 5/00 |
| DE | 297 13 958 | | 11/1997 | C21D 1/673 |
| EP | 0 077 511 | | 10/1982 | B22D 29/00 |
| EP | 0546210 | A1 | 6/1993 | B22D 29/00 |
| EP | 0 610 028 | | 8/1994 | F27D 3/00 |
| EP | 0 716 152 | | 6/1996 | C21D 9/00 |
| EP | 0 796 920 | | 9/1997 | C21D 1/667 |
| FR | 823 437 | | 10/1936 | |
| FR | 7043571 | | 12/1970 | G01N 15/00 |
| FR | 2448573 | | 2/1979 | C21D 9/00 |
| FR | 2 630 199 | | 4/1988 | F27B 9/10 |
| GB | 1392405 | | 4/1975 | G01N 25/00 |
| GB | 1564151 | | 4/1980 | F27B 15/00 |
| GB | 1569152 | | 6/1980 | F23G 7/00 |
| GB | 2 137 114 | A | 10/1984 | |
| GB | 2187398 | | 9/1987 | F27B 15/09 |
| GB | 2230720 | | 10/1990 | B22O 29/00 |
| GB | 2248569 | | 4/1992 | B22D 29/00 |
| JP | S55-149772 | | 11/1980 | |
| JP | 5653867 | | 5/1981 | B22D 29/00 |
| JP | 5939464 | | 8/1982 | B22D 29/00 |
| JP | 5825860 | | 2/1983 | B22D 29/00 |
| JP | 58025417 | | 2/1983 | C21D 1/00 |
| JP | 59219410 | | 12/1984 | C21D 1/63 |
| JP | 6092040 | | 5/1985 | B22C 3/00 |
| JP | 6274022 | | 9/1985 | C21D 5/00 |
| JP | 61007058 | | 1/1986 | B22D 29/00 |
| JP | 62110248 | | 5/1987 | H01J 37/28 |
| JP | 6316853 | | 1/1988 | |
| JP | 63108941 | | 5/1988 | B22C 5/00 |
| JP | 63-165207 | | 7/1988 | B65G 13/00 |
| JP | 1-91957 | | 4/1989 | B22D 29/00 |
| JP | 1-122658 | | 5/1989 | B22D 29/00 |
| JP | 2104164 | | 8/1990 | B22D 29/00 |
| JP | 3-465 | | 1/1991 | B22D 29/00 |
| JP | 08132220 | A | 5/1996 | B22D 29/00 |
| JP | 11-147730 | | 2/1999 | C03B 35/16 |
| JP | 2002-195755 | | 7/2002 | F27B 9/36 |
| KR | 00259900 | | 3/2000 | B62D 65/00 |
| SU | 1129012 | | 7/1982 | B22C 5/00 |
| SU | 0234810 | | 3/1985 | |
| WO | WO 97/30805 | | 8/1997 | B22C 25/00 |
| WO | WO 98/14291 | | 4/1998 | B22D 29/00 |
| WO | WO 00/36354 | A1 | 6/2000 | F27B 5/04 |
| WO | WO 01/08836 | A1 | 2/2001 | B22D 29/00 |
| WO | WO 02/063051 | | 8/2002 | C21D 9/00 |
| WO | WO 02/081127 | A2 | 10/2002 | B22D 5/08 |
| WO | WO 2004/007120 | | 1/2004 | B22D 29/00 |
| WO | WO 2005/121386 | | 12/2005 | C22F 1/00 |
| WO | WO 2006/050209 | | 5/2006 | C21D 5/00 |

OTHER PUBLICATIONS

Brochures describing Beardsley & Pipe PNEU-RECLAIM Sand Reclamation Units Prior to Aug. 13, 1992.

Brochure describing Fataluminum Sand Reclamation Units—Prior to Aug. 13, 1992.

Paul M. Crafton—Heat Treating Aging System Also Permits Core Sand Removal—Reprinted from Sep. 1989 Modern Castings magazine.

Sales brochure describing Thermfire Brand Sand Reclamation, Gudgeon Bros., Ltd. believed to be known to others prior to Sep. 1989.

Sales brochure describing Simplicity/Richards Gas-Fired Thermal Reclamation System Simplicity Engineering, Inc.—believed to be known to others prior to Sep. 1989.

Sales brochure describing AirTrac Brand Fluidizing Conveyor, Air Trac Systems Corp., believed to be known to others prior to Sep. 1989.

Sales brochure describing Fluid Bed Calcifer Thermal Sand Reclamation Systems, Dependable Foundry Equipment Co.—Believed to be known to others prior to Sep. 1989.

Foundry Management & Technology—Dec. 1989—vol. 117; No. 12; p. G3—Shakeout/Cleaning/Finishing Brochure.

ASM Handbook, vol. 4, Heat Treating, pp. 465-464, (Apr. 1993).

The Making, Shaping and Treating of Steel, pp. 1267-1276 ($10^{th}$ Edition—Dec. 1989).

Preliminary Remarks dated Jul. 30, 1991 and filed in U.S. Appl. No. 07/705,626.

Declaration of Paul M. Crafton and Scott P. Crafton dated Jul. 26, 1991 and filed in U.S. Appl. No. 07/705,626.

On Sale Description Regarding System of Consolidated Engineering System (before Aug. 13, 1992).

"What are the types of forging processes?"—Forging Industry Association—5 pages—2002.

"Manufacturing Processes—Additional Casting Processes"—Arthur D. Roberts and Samuel C. Lapidge—Manufacturing Engineering Technology—1977—pp. 319-336.

"Manufacturing Processes—Forging Processes"—Arthur D. Roberts and Samuel C. Lapidge—Manufacturing Engineering Technology—1977—pp. 363-377.

"Manufacturing Processes—Sand Casting"—Arthur D. Roberts and Samuel C. Lapidge—Manufacturing Engineering Technology—1977—pp. 303-318.

Efunda engineering fundamentals—"Squeeze Casting"—1 page—2005.

New Claims as filed on Nov. 22, 2007, in co-pending European patent application No. 05815342.0, filing date Oct. 31, 2005.

Notification of Transmittal of the International Search Report & the Written Opinion of the International Searching Authority, or the Declaration from co-pending PCT application No. PCT/US05/039157, filing date Oct. 31, 2005.

Written Opinion of the International Searching Authority from co-pending PCT application No. PCT/US05/039157, filing date Oct. 31, 2005.

Technology Spotlight advertorial—Consolidated Engineering Company—Innovative Engineered Systems for rapid heating/de-coring/quenching—Shanker Subramanian, Technical Director—Jan. 2005.

Office Action dated Jan. 12, 2011, from co-pending Japanese Patent Application No. 2007-539215.

* cited by examiner

HIGH PRESSURE HEAT TREATMENT SYSTEM

CROSS REFERENCE TO RELATED APPLICATIONS

This application is a continuation of application Ser. No. 12/393,099, filed Feb. 26, 2009, now abandoned, which application is a continuation of application Ser. No. 11/261,263, filed Oct. 28, 2005, now abandoned, which application claims the benefit of U.S. Provisional Application No. 60/623,716, filed Oct. 29, 2004, and U.S. Provisional Application No. 60/667,230, filed Apr. 1, 2005, all of which are incorporated by reference herein in their entirety.

FIELD OF THE INVENTION

The present invention relates generally to the field of foundry processing and, more particularly, to the heat treatment of metal castings.

BACKGROUND

In the field of metal processing, it is well known that heat treatment of a metal workpiece typically requires a significant amount of the time to attain the desired resulting properties. Thus, there is a continuing need for processes that reduce the time required to heat treat the workpiece.

BRIEF DESCRIPTION OF THE DRAWINGS

Various objects, features, and advantages of the present invention will become apparent upon reading and understanding this specification, taken in conjunction with the accompanying drawings. The dimensions shown in the drawings represent only one example of an embodiment of the invention. Segments represented by a "Z" (e.g. Z1, Z2, etc.) represent individual zones of multi-zone furnaces.

DETAILED DESCRIPTION

Figure 1:
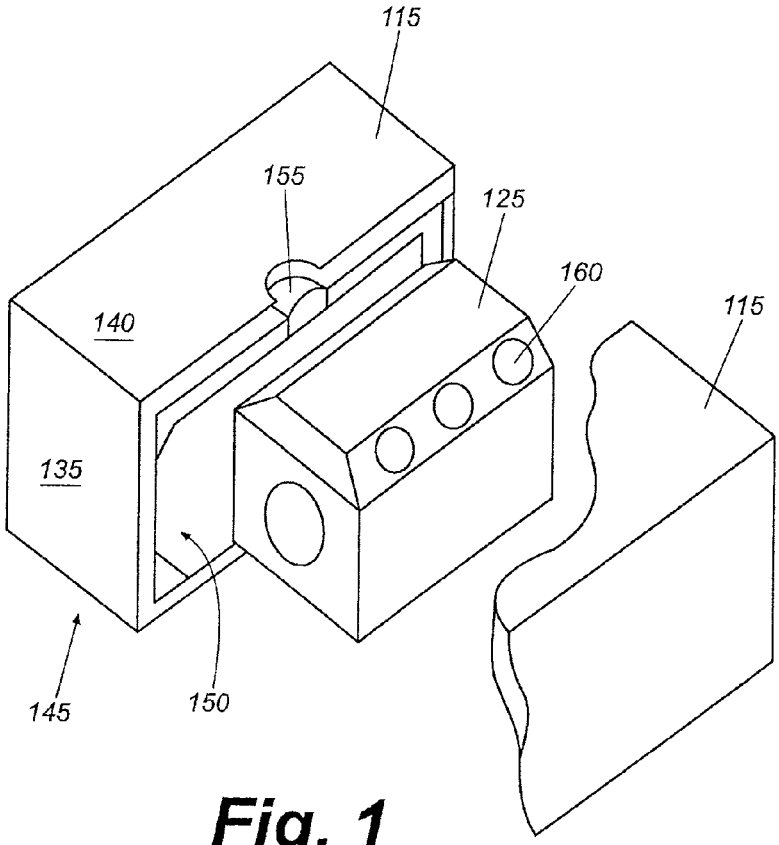
FIG. 1 is a perspective view of an exemplary casting that may be heat treated in accordance with the present invention.

Briefly described, the present invention relates to a system for processing one or more metal workpieces. The workpieces may be metal castings, forged metal billets, or any other metal workpieces that require or benefit from heat treatment. The system may be used to heat treat workpieces that are formed using a sand mold or metal die, optionally with one or more sand cores, workpieces that are formed without a sand mold, a core, or a metal die, and workpieces from which the sand mold, core, and/or die are removed prior to heat treatment. The system of the present invention includes a heat treatment furnace with at least one "heat-up" zone. The system may include a mechanism for rotating and inverting the workpiece during heat treatment and/or mold and core removal.

U.S. Patent Application No. 60/623,716, filed Oct. 29, 2004, and U.S. Patent Application No. 60/667,230, filed Apr. 1, 2005, are incorporated by reference herein in their entirety.

Formation of the Workpiece

Processes used to form a metal workpiece, for example, a wheel or an automobile cylinder head or engine block, are well known to those of skill in the art and are described only generally herein.

For example, a typical forging process involves subjecting a pre-formed metal blank to mechanicals forces to cause the metal to take the desired shape. Impression die (or "closed-die") forging generally involves pressing a metal between two dies having a profile of the desired part. Cold forging generally involves applying a mechanical force to deform the metal at about or above ambient temperature. Open die forging generally involves use of flat, unprofiled dies. Seamless rolled ring forging generally involves punching a hole in a thick, round piece of metal, followed by rolling and squeezing to create a thin ring.

As still another example, a typical squeeze casting process (also known as "liquid metal forging") involves pouring a molten metal into the bottom half of a two-part preheated die. As the metal begins to solidify, the upper half of the die closes and applies pressure to the cooling metal. Less pressure is used and, therefore, more detailed parts can be produced.

As yet another example, a typical metal casting process generally involves pouring a molten metal or metallic alloy into a mold or die to form a casting. The molten metal may be injected into the die under high pressure or under low pressure, for example, by gravity feed.

The exterior features of the desired casting to be formed are provided on the interior surfaces of the mold or die. The casting is subjected to various combinations of processing steps resulting in mold removal, core removal (where used), heat-treating, reclamation of any sand from sand cores (where used), and, at times, aging.

Various types of molds or dies may be used in a metal casting process including, but not limited to, green sand molds, precision sand molds, semi-permanent molds, permanent metal dies, and investment dies.

In one aspect, the mold or die is a permanent mold or die that may be formed from a metal such as cast iron, steel, or other material. In this aspect, the mold or die may have a clam-shell style design for easy removal of the casting therefrom. In another aspect, the mold is a precision sand mold, which is generally formed from a granular material, such as silica, zircon, other sands, or any combination thereof, mixed with a binder, for example, a phenolic resin or other suitable organic or inorganic binder material. In yet another aspect, the mold is a semi-permanent sand mold formed from a sand and binder, or from a metal, for example steel, or a combination thereof.

In this and other aspects of the present invention, one or more cores (not shown) may be used with the mold or die to create hollow cavities and/or casting details within the casting. The core typically is formed from a sand material and a suitable binder, such as a phenolic resin, phenolic urethane "cold box" binder, or other suitable organic or inorganic binder material as needed or desired.

In still another aspect, the mold is an investment die. An investment casting process involves use of an expendable pattern, typically made by injecting wax or plastic into a metal mold. The pattern then is coated, by either pouring or dipping, with a refractory slurry (i.e., watery paste of silica and a binder) that sets at ambient temperature to produce a mold or shell. After hardening, the mold is turned upside down and the expendable pattern (wax or plastic) is melted out of the mold. To complete this refractory mold, one or more ceramic cores may be inserted. Investment castings can be made in almost any pourable metal or alloy.

As FIG. 1 illustrates, each mold or die 115 generally includes a plurality of side walls 135, a top or upper wall 140, and lower wall or bottom 145, which define an internal cavity 150 into which the molten metal is poured. The internal cavity 150 is formed with a relief pattern for forming the internal features of the casting 125. A pour opening 155 is provided in the side wall 135, upper wall 140, or bottom wall 145 of each mold and communicates with the internal cavity 150 to permit the molten metal to be poured or otherwise introduced into the mold. The resulting casting 125 has the features of the internal cavity 150 of the mold 115, with additional core apertures or access openings 160 also being formed therein where one or more sand cores are used.

Additionally, the mold may be provided with one or more riser openings (not shown) to serve as reservoirs for molten metal. These reservoirs supply extra metal to fill the voids formed by shrinkage as the metal cools and passes from the liquid to the solid state. When the cast article is removed from the mold, the solidified metal in the opening remains attached to the casting as a projection or "riser" (not shown). These risers are non-functional and are subsequently removed, typically by mechanical means.

A heating source or element, such as a heated air blower or other suitable gas-fired heater mechanism, electric heater mechanism, fluidized bed, or any combination thereof may be provided adjacent the pouring station for preheating the mold. Typically, the mold is preheated to a desired temperature depending upon the metal or alloy used to form the casting. For example, for aluminum, the mold may be preheated to a temperature of from about 400° C. to about 600° C. The varying preheating temperatures required for preheating the various metallic alloys and other metals for forming castings are well known to those skilled in the art and can include a wide range of temperatures above and below from about 400° C. to about 600° C. Additionally, some mold types require lower process temperatures to prevent mold deterioration during pouring and solidification. In such cases, and where the metal process temperature should be higher, a suitable metal temperature control method, such as induction heating, may be employed.

Alternatively, the mold may be provided with internal heating sources or elements for heating the mold. For example, where a casting is formed in a permanent type metal die, the die may include one or more cavities or passages formed adjacent the casting and in which a heated medium such as a thermal oil is received and/or circulated through the dies for heating the dies. Thereafter, thermal oils or other suitable media may be introduced or circulated through the die, with the oil being of a lower temperature, for example, from about 250° C. to about 300° C., to cool the casting and cause the casting to solidify. A higher temperature thermal oil, for example, heated to from about 500° C. to about 550° C., then may be introduced and/or circulated through the die to arrest cooling and raise the temperature of the casting back to a soak temperature for heat treating. The pre-heating of the die and/or introduction of heated media into the die may be used to initiate heat treatment of the casting. Further, preheating helps maintain the metal of the casting at or near a heat treatment temperature to minimize heat loss as the molten metal is poured into the die, solidified, and transferred to a subsequent processing station for heat treatment. If desired, the casting may be transported through a radiant tunnel to prevent or minimize cooling of the casting.

Processing of the Workpiece

It will be understood that the various aspects of the present invention disclosed herein can be used for processing numerous types of workpieces formed using any process.

FIGS. 2-10 depict exemplary processing systems according to various aspects of the present invention. The system may be used to process workpieces that are formed in a sand mold, optionally with one or more sand cores (FIGS. 2-5). Alternatively, the system may be used to process workpieces that are formed without using a sand mold or cores (FIGS. 6-10). Alternatively still, the system may be used to process workpieces from which the sand mold and cores have been removed prior to heat treating (FIGS. 6-10).

Figure 2:
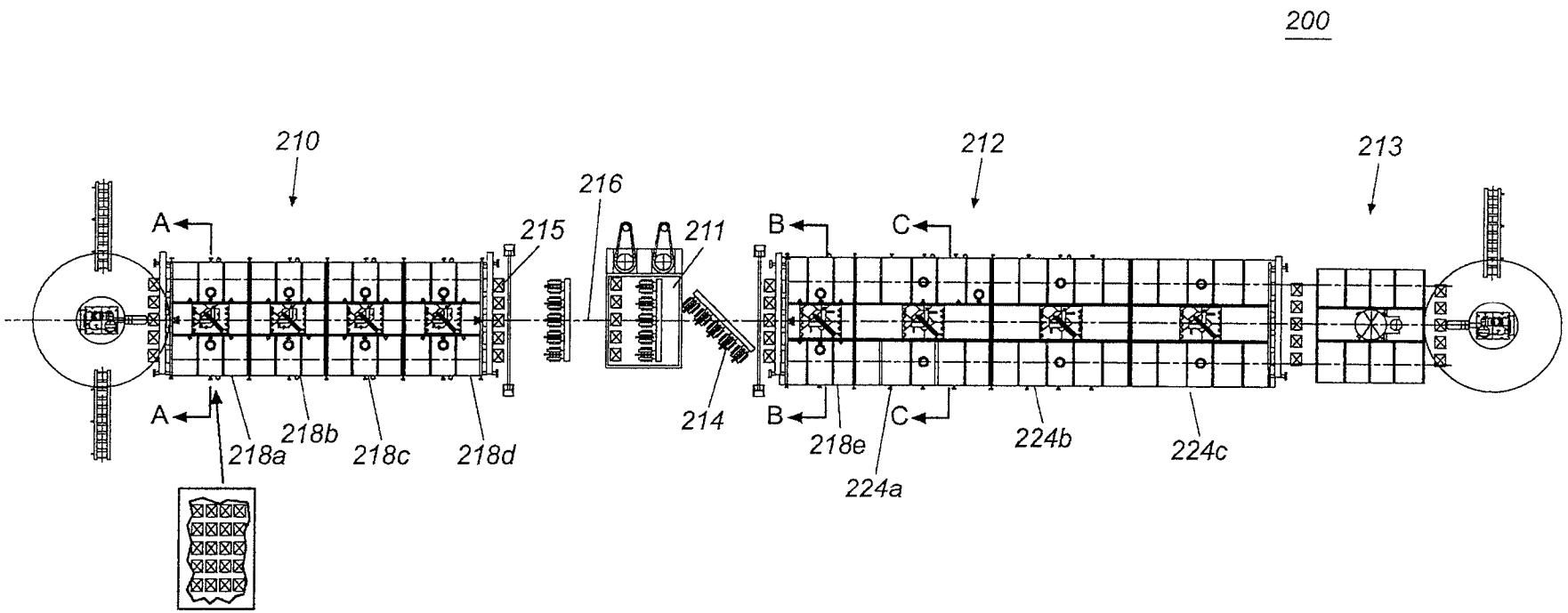
FIG. 2 is a top plan view of an exemplary system according to the present invention.

FIG. 2 illustrates an exemplary processing system 200 that includes a heat treatment furnace 210 (also referred to as a "solution furnace"), quench 211, age oven 212, and cool unit 213. Movement to, between, and from the furnace 210, age oven 212, and cool unit 213 is aided by robotic means or transfer systems 214 for continuous operation of the system 200. The workpieces 215 are shown as automotive wheels, but it should be understood that other workpieces are contemplated hereby. If desired, a multi-level "shelving" or "stacking" system such as that illustrated in FIGS. 3-5 may be used to increase the capacity of the furnace 210, oven 212, and/or cool unit 213. The mechanism used to convey the components through the furnace and oven may include a basket or racking system, such as those known to those of skill in the art. Alternatively, a direct contact conveyance mechanism such as a chain 216, roller, walking beam, or other similar mechanism may be employed.

Typically, during the transfer of the workpieces from the forming station to the heat treatment station or furnace, and especially if the workpieces are allowed to sit for any appreciable amount of time, the workpieces may be exposed to the ambient environment of the foundry or metal processing facility. As a result, the workpieces tend to cool rapidly from a molten or semi-molten temperature. While some cooling is necessary to allow the workpieces to solidify, it has been discovered that, as the metal of the workpiece is cooled down, it reaches a temperature or range of temperatures referred to herein as the "process control temperature" or "process critical temperature", below which the time required to both raise the workpieces to the heat treating temperature and perform the heat treatment is significantly increased. In one aspect, it has been found that for certain types of metals, for every minute of time that the workpiece drops below its process control temperature, more than one minute of additional heat treatment time is required to achieve the desired resulting properties. Thus, for example, dropping below the process control temperature for the metal of the workpiece for as few as ten minutes may require more than ten minutes of additional heat treatment time. For example, it has been found that for certain types of metals, for every minute of time that the workpiece drops below its process control temperature, at least about 2 minutes of extra heat treatment time is required to achieve the desired results. As another example, it has been found that for certain types of metals, for every minute of time that the workpiece drops below its process control temperature, at least about 3 minutes of extra heat treatment time is required to achieve the desired results. As still another example, it has been found that for certain types of metals, for every minute of time that the workpiece drops below its process control temperature, at least about 4 minutes of extra heat treatment time is required to achieve the desired results. In this example, dropping below the process control temperature for the metal of the workpiece for as few as ten minutes may require more than 40 minutes of additional heat treatment time to achieve the desired physical properties. Typically, many workpieces must be heat treated for 2 to 6 hours, in some cases longer, to achieve the desired heat treatment effects. This results in greater utilization of energy and, therefore, greater heat treatment costs.

It will be understood by those skilled in the art that the process control temperature for the workpieces being processed by the present invention will vary depending upon the particular metal and/or metal alloys being used for the workpieces, the size and shape of the workpieces, and numerous other factors.

In one aspect, the process control temperature may be about 400° C. for some alloys or metals. In another aspect, the process control temperature may be from about 400° C. to about 600° C. In another aspect, the process control temperature may be from about 600° C. to about 800° C. In yet another aspect, the process control temperature may be from about 800° C. to about 1100° C. In still another aspect, the process control temperature may be from about 1000° C. to about 1300° C. for some alloys or metals, for example, iron. In one particular example, an aluminum/copper alloy may have a process control temperature of from about 400° C. to about 470° C. In this example, the process control temperature generally is below the solution heat treatment temperature for most copper alloys, which typically is from about 475° C. to about 495° C. While particular examples are provided herein, it will be understood that the process control temperature may be any temperature, depending upon the particular metal and/or metal alloys being used for the workpieces, the size and shape of the workpieces, and numerous other factors.

When the metal of the workpiece is within the desired process control temperature range, the workpiece typically will be cooled sufficiently to solidify as desired. However, if the metal of the workpiece is permitted to cool below its process control temperature, it has been found that the workpiece may need to be heated for more than, for example, one additional minute for each minute that the metal of the workpiece is cooled below the process control temperature to reach the desired heat treatment temperature, for example, from about 475° C. to about 495° C. for aluminum/copper alloys, or from about 510° C. to about 570° C. for aluminum/magnesium alloys. Thus, if the workpieces cool below their process control temperature for even a short time, the time required to heat treat the workpieces properly and completely may be increased significantly. In addition, it should be recognized that in a batch processing system, where several workpieces are processed through the heat treatment station in a single batch, the heat treatment time for the entire batch of workpieces generally is based on the heat treatment time required for the workpiece(s) with the lowest temperature in the batch. As a result, if one of the workpieces in the batch being processed has cooled to a temperature below its process control temperature, for example, for about 10 minutes, the entire batch typically will need to be heat treated, for example, for at least an additional 40 minutes to ensure that all of the workpieces are heat treated properly and completely.

Various aspects of the present invention therefore are directed to systems that are designed to move and/or transition the workpieces (within or apart from their molds) from the pouring station to the heat treatment station or furnance, while arresting cooling of the molten metal to a temperature at or above the process control temperature of the metal, but below or equal to the desired heat treatment temperatures thereof to allow the workpieces to solidify. Accordingly, various aspects of the present invention include systems for monitoring the temperature of the workpieces to ensure that the workpieces are maintained substantially at or above the process control temperature. For example, thermocouples or other similar temperature sensing devices or systems can be placed on or adjacent the workpieces or at spaced locations along the path of travel of the workpieces from the pouring station to a heat treatment furnace to provide substantially continuous monitoring. Alternatively, periodic monitoring at intervals determined to be sufficiently frequent may be used. Such devices may be in communication with a heat source, such that the temperature measuring or sensing device and the heat source may cooperate to maintain the temperature of the workpiece substantially at or above the process control temperature for the metal of the workpiece. It will be understood that the temperature of the workpiece may be measured at one particular location on or in the workpiece, may be an average temperature calculated by measuring the temperature at a plurality of locations on or in the workpiece, or may be measured in any other manner as needed or desired for a particular application. Thus, for example, the temperature of the workpiece may be measured in multiple locations on or in the workpiece, and an overall temperature value may be calculated or determined to be the lowest temperature detected, the highest temperature detected, the median temperature detected, the average temperature detected, or any combination or variation thereof.

Additionally, prior to entry into the heat treatment furnace, the workpieces may pass through an entry or rejection zone, where the temperature of each workpiece is monitored to determine whether the workpiece has cooled to an extent that would require and an excessive amount of energy to raise the temperature to the heat treatment temperature. The entry zone may be included in the process control temperature station, or may be a separate zone, as indicated generally throughout the various figures. The temperature of the workpiece may be monitored by any suitable temperature sensing or measuring device, such as a thermocouple, to determine whether the temperature of the workpiece has reached or dropped below a pre-set or predefined rejection temperature. In one aspect, the predefined rejection temperature may be a temperature (for example, from about 10° C. to about 20° C.) below the process control temperature for the metal of the workpiece. In another aspect, the predefined rejection temperature may be a temperature (for example, from about 10° C. to about 20° C.) below the heat treatment temperature of the heat treatment furnace or oven. If the workpiece has cooled to a temperature equal to or below the predefined temperature, the control system may send a rejection signal to a transfer or removal mechanism. In response to the detection of a defect condition or signal, the subject workpiece may be identified for further evaluation or may be removed from the transfer line. The workpiece may be removed by any suitable mechanism or device including, but not limited to, a robotic arm or other automated device, or the workpiece may be removed manually by an operator.

As with the above, it will be understood that the temperature of the workpiece may be measured at one particular location on or in the workpiece, may be an average temperature calculated by measuring the temperature at a plurality of locations on or in the workpiece, or may be measured in any other manner as needed or desired for a particular application. Thus, for example, the temperature of the workpiece may be measured in multiple locations on or in the workpiece, and an overall value may be calculated or determined to be the lowest temperature detected, the highest temperature detected, the median temperature detected, the average temperature detected, or any combination or variation thereof.

Where molds are used, the molds may be preheated to assist with maintaining the temperature of the metal at or above a predetermined process control temperature. Additionally or alternatively, the pouring or forming station may be positioned adjacent the heat treatment furnace to limit the loss of temperature of the mold and/or workpiece as the mold is moved from the pouring station to the furnace. Further, a temperature arresting chamber, radiant tunnel, or other device or system may be used at or proximate the entrance to the furnace to maintain the temperature of the metal at or above the process control temperature. The benefits of maintaining the temperature of the workpiece at or above the process control temperature are described further in U.S. patent application Ser. No. 10/051,666, which is incorporated by reference herein in its entirety. However, in some processes, the workpiece may enter the heat treatment furnace below a predetermined process control temperature.

If desired, all or a portion of any external sand molds may be removed prior to entry into the furnace. Various techniques for removing a sand mold are provided in U.S. Pat. No. 6,622,775, which is incorporated by reference herein in its entirety. Additional techniques for removing a mold are provided in U.S. patent application Ser. No. 10/616,750, incorporated by reference herein in its entirety. Other mechanical techniques (chiseling, vibrating, etc.) known in the industry are also contemplated hereby. The removed sand molds may be diverted to a sand re-claimer where the sand is cleaned for reuse or deposited into the furnace for reclamation, as will be discussed further below.

Returning to FIG. 2, the furnace 210 and age oven 212 each may incorporate one or more high pressure heating zones ("heat-up" zones) 218*a*, 218*b*, 218*c*, 218*d*, 218*e* that provide localized, directed, high pressure fluid flow to each workpiece 215, rather than (or in addition to) conventional mass air flow. Depending on the type of workpiece used, the high pressure heating can provide various benefits.

For example, where no mold or core is used (or where it has been removed), the system of the present invention has been shown to reduce heat treatment time by as much as 20%. Additionally, the high pressure impinging of fluid at the workpiece has been shown to decrease the time for de-molding and/or de-coring and the overall heat treatment processing time. If the mold/cores are formed utilizing a combustible formula, the fluid media also increases the removal of the mold/cores by adding oxygen to promote binder combustion. If the mold/cores are formed from inorganic or organic water soluble composition, the pressurized fluid media assists in the removal by the reaction of direct contact (blasting) of the pressurized fluid to the mold/cores. Furthermore, the actual "brute" force of the media can assist in the removal of mold and/or core composition by dislodging portions of the mold and/or core from the workpiece. By way of example and not limitation, by positioning one or more nozzles within 2 inches of the workpiece, the retained sand around the workpiece may be reduced by as much as 50%. It is believed that the heat treatment time can be reduced further with certain binder compositions.

Figure 3:
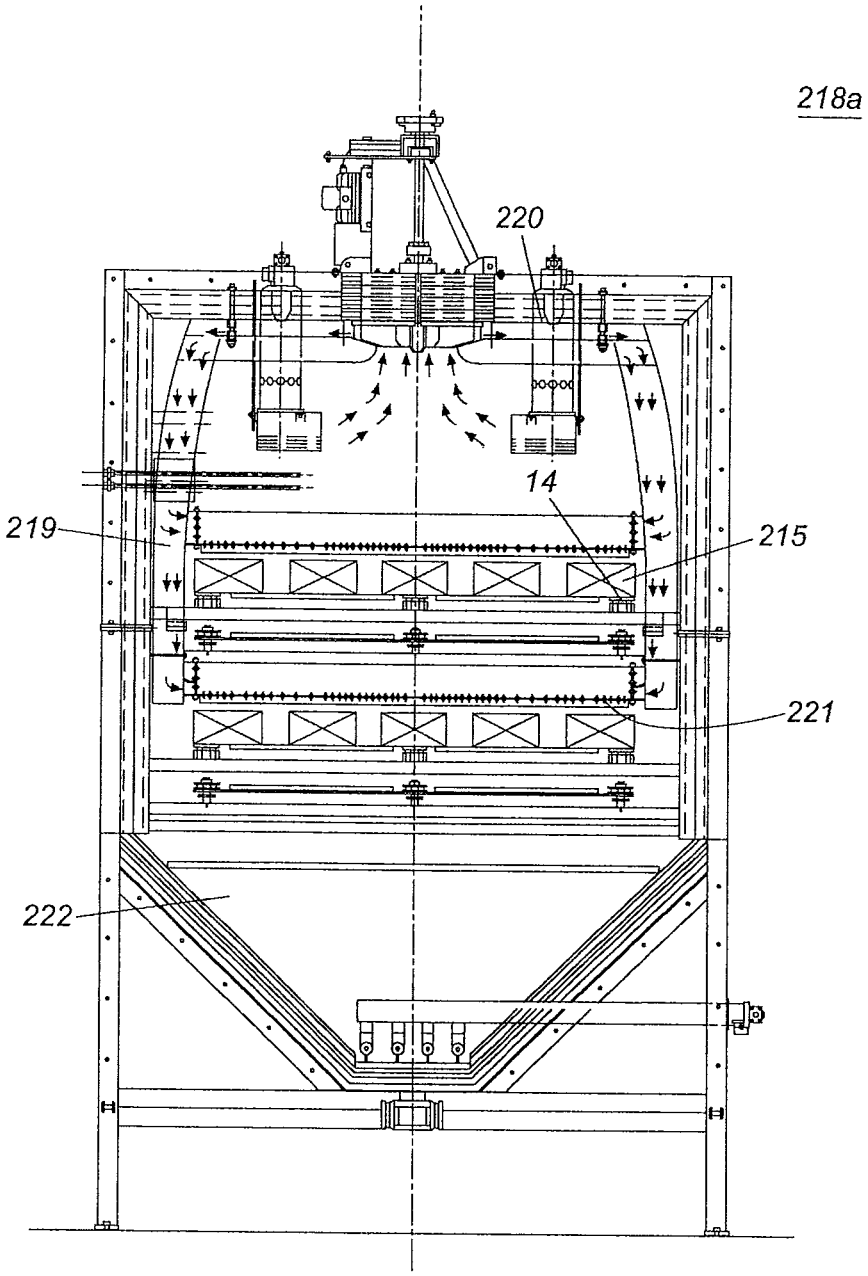
FIG. 3 is a cross-sectional view of the exemplary heat treatment furnace depicted in FIG. 2 taken along a line A-A.
Figure 4:
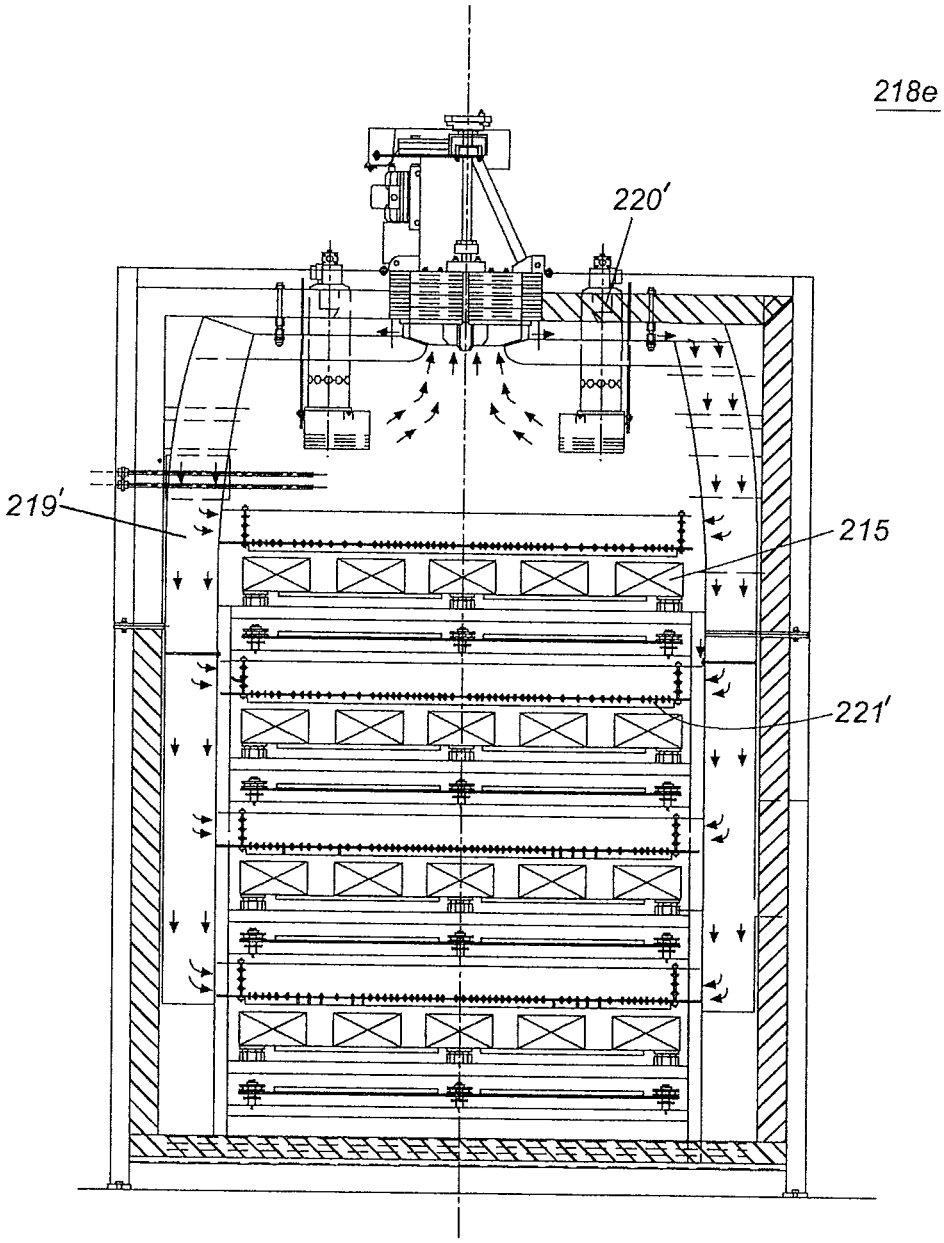
FIG. 4 is a cross-sectional view of the exemplary age oven depicted in FIG. 2 taken along a line B-B.

FIGS. 3 and 4 illustrate an exemplary heat-up zone 218*a*, 218*e* in the heat treatment furnace 210 and age oven 212 of FIG. 2, respectively. The heat-up zone 218*a*, 218*e* includes a fluid channeling duct system 219, 219' for directing a flow of fluid at the workpiece 215. The system includes a supply of air or other fluid that may be heated by one or more burners 220, 220'. The channeling duct system 219, 219' directs the air to the workpieces via one or more orifices, slots, nozzles, impingement tubes, or any other fluid circulation device or system known to those in the art (collectively "impingement devices"), shown as element 221, 221'. The channeling duct system may include a plurality of zones or stations positioned sequentially through the heat-up zone with the one or more orifices, slots, nozzles, or impingement tubes oriented in a pre-defined arrangement corresponding to known positions of the workpieces. Each station may be controlled remotely through an electronic control system.

The location and design of the nozzles, slots, etc. including, but not limited to, the actual distance that the fluid media needs to travel to impinge the workpiece, the design of the flow pattern of the fluid media, and other flow parameters will depend on the type and size of workpiece.

According to one aspect of the present invention, at least one nozzle or other impingement device may have an opening of from about ⅛ in. wide to about 6 in wide in diameter. In one aspect, at least one impingement device has an opening that is about ⅛ in. wide. In another aspect, at least one impingement device has an opening that is about ¼ in. wide. In another aspect, at least one impingement device has an opening that is about ⅜ in. wide. In yet another aspect, at least one impingement device has an opening that is about ½ in. wide. In still another aspect, at least one impingement device has an opening that is about ⅝ in. wide. In yet another aspect, at least one impingement device has an opening that is about ¾ in. wide. In another aspect, at least one impingement device has an opening that is about ⅞ in. wide. Other impingement device opening widths are contemplated hereby.

In a further aspect, at least one impingement device has an opening that is less than about 1 in. wide in diameter. In another aspect, at least one impingement device has an opening that is less than about 2 in. wide. In yet another aspect, at least one impingement device has an opening that is less than about 3 in. wide. In still another aspect, at least one impingement device has an opening that is less than about 4 in. wide. In a further aspect, at least one impingement device has an opening that is less than about 5 in. wide. In another aspect, at least one impingement device has an opening that is less than about 6 in. wide. While certain impingement device opening widths and ranges of widths are set forth herein, it will be understood that any suitable impingement device diameter may be used in accordance with the present invention to achieve the desired results. Thus, other opening diameters are contemplated hereby.

According to another aspect of the present invention, at least one nozzle or other impingement device may be positioned from about 0.5 in. to about 10 in. from the workpiece to impinge or blast the fluid onto and around the mold, workpiece, and/or core(s). In one aspect, at least one impingement device is from about 1 to about 8 in. from the workpiece. In another aspect, at least one impingement device is from about 2 to about 6 in. from the workpiece. In still another aspect, at least one impingement device is from about 1.5 to about 3 in. from the workpiece. In another aspect, at least one impingement device is from about 3 to about 7 in. from the workpiece. In another aspect, at least one impingement device is from about 4 to about 9 in. from the workpiece. In still another aspect, at least one impingement device is from about 1 to about 4 in. from the workpiece. In another aspect, at least one impingement device is from about 2 to about 5 in. from the workpiece. In yet another aspect, at least one impingement device is from about 0.5 to about 6 in. from the workpiece. In still another aspect, at least one impingement device is from about 1 to about 4 in. from the workpiece.

For example, in one aspect, at least one impingement device is about 10 in. from the workpiece. In another aspect, at least one impingement device is about 9 in. from the workpiece. In yet another aspect, at least one impingement device is about 8 in. from the workpiece. In still another aspect, at least one impingement device is about 7 in. from the workpiece. In another aspect, at least one impingement device is about 6 in. from the workpiece. In yet another aspect, at least one impingement device is about 5 in. from the workpiece. In still another aspect, at least one impingement device is about 4 in. from the workpiece. In another aspect, at least one impingement device is about 3 in. from the workpiece. In yet another aspect, at least one impingement device is about 2 in. from the workpiece. In still another aspect, at least one impingement device is about 1 in. from the workpiece.

In still another aspect, at least one impingement device is less than about 10 in. from the workpiece. In another aspect, at least one impingement device is less than about 9 in. from the workpiece. In yet another aspect, at least one impingement device is less than about 8 in. from the workpiece. In a further aspect, at least one impingement device is less than about 7 in. from the workpiece. In another aspect, at least one impingement device is less than about 6 in. from the workpiece. In yet another aspect, at least one impingement device is less than about 5 in. from the workpiece. In a further aspect, at least one impingement device is less than about 4 in. from the workpiece. In another aspect, at least one impingement device is less than about 3 in. from the workpiece. In yet another aspect, at least one impingement device is less than about 2 in. from the workpiece. In a further aspect, at least one impingement device is less than about 1 in. from the workpiece. While various distances and ranges of distances are provided herein, it will be understood that each impingement device may be positioned as needed to achieve the desired results. Thus, numerous other possible positions are contemplated hereby.

The fluid medium generally may be delivered to the workpiece at a discharge velocity of from about 4,000 and 40,000 feet per minute (ft/min). In one aspect, the fluid medium is discharged from the impingement device at a velocity of from about 4,000 to about 20,000 ft/min. In another aspect, the fluid medium is discharged from the impingement device at a velocity of from about 8,000 to about 25,000 ft/min. In yet another aspect, the fluid medium is discharged from the impingement device at a velocity of from about 6,000 to about 15,000 ft/min. In still another aspect, the fluid medium is discharged from the impingement device at a velocity of from about 15,000 to about 30,000 ft/min. In a further aspect, the fluid medium is discharged from the impingement device at a velocity of from about 5,000 to about 12,000 ft/min. In one particular aspect, the fluid medium is discharged from the impingement device at a velocity of about 10,000 ft/min. In another aspect, the fluid medium is discharged from the impingement device at a velocity of from about 7,000 to about 13,000 ft/min. In yet another aspect, the fluid medium is discharged from the impingement device at a velocity of from about 18,000 to about 22,000 ft/min. In still another aspect, the fluid medium is discharged from the impingement device at a velocity of from about 9,000 to about 14,000 ft/min. In a further aspect, the fluid medium is discharged from the impingement device at a velocity of from about 5,000 to about 17,000 ft/min.

In one aspect, the fluid medium is discharged from the impingement device at a velocity of at least about 4,000 ft/min. In another aspect, the fluid medium is discharged from the impingement device at a velocity of at least about 5,000 ft/min. In yet another aspect, the fluid medium is discharged from the impingement device at a velocity of at least about 6,000 ft/min. In another aspect, the fluid medium is discharged from the impingement device at a velocity of at least about 7,000 ft/min. In still another aspect, the fluid medium is discharged from the impingement device at a velocity of at least about 8,000 ft/min. In yet another aspect, the fluid medium is discharged from the impingement device at a velocity of at least about 10,000 ft/min. In another aspect, the fluid medium is discharged from the impingement device at a velocity of at least about 11,000 ft/min. In a further aspect, the fluid medium is discharged from the impingement device at a velocity of at least about 12,000 ft/min. In another aspect, the fluid medium is discharged from the impingement device at a velocity of at least about 13,000 ft/min. In yet another aspect, the fluid medium is discharged from the impingement device at a velocity of at least about 14,000 ft/min. In another aspect, the fluid medium is discharged from the impingement device at a velocity of at least about 15,000 ft/min. In still another aspect, the fluid medium is discharged from the impingement device at a velocity of at least about 16,000 ft/min. In yet another aspect, the fluid medium is discharged from the impingement device at a velocity of at least about 17,000 ft/min. In another aspect, the fluid medium is discharged from the impingement device at a velocity of at least about 18,000 ft/min. In a further aspect, the fluid medium is discharged from the impingement device at a velocity of at least about 19,000 ft/min. In another aspect, the fluid medium is discharged from the impingement device at a velocity of at least about 20,000 ft/min. In yet another aspect, the fluid medium is discharged from the impingement device at a velocity of at least about 25,000 ft/min. In another aspect, the fluid medium is discharged from the impingement device at a velocity of at least about 30,000 ft/min. In still another aspect, the fluid medium is discharged from the impingement device at a velocity of at least about 35,000 ft/min. It will be understood that while various velocities and ranges of velocities are provided herein, other velocities may be used in accordance with the present invention to achieve the desired results. Thus, numerous other velocities and ranges thereof are contemplated hereby.

The fluid medium generally may be delivered to workpiece at a flow rate of from about 50 to about 500 standard cubic feet per minute per foot of nozzle or other impingement device (scfm/ft). In one aspect, the fluid medium is delivered to the workpiece at a flow rate of from about 50 to about 100 scfm/ft. In another aspect, the fluid medium is delivered to the workpiece at a flow rate of from about 100 to about 150 scfm/ft. In another aspect, the fluid medium is delivered to the workpiece at a flow rate of from about 150 to about 200 scfm/ft. In another aspect, the fluid medium is delivered to the workpiece at a flow rate of from about 200 to about 250 scfm/ft. In another aspect, the fluid medium is delivered to the workpiece at a flow rate of from about 250 to about 300 scfm/ft. In still another aspect, the fluid medium is delivered to the workpiece at a flow rate of from about 300 to about 350 scfm/ft. In yet another aspect, the fluid medium is delivered to the workpiece at a flow rate of from about 350 to about 400 scfm/ft. In another aspect, the fluid medium is delivered to the workpiece at a flow rate of from about 400 to about 450 scfm/ft. In still another aspect, the fluid medium is delivered to the workpiece at a flow rate of from about 450 to about 500 scfm/ft. In one particular aspect, the fluid medium is delivered to the workpiece at a flow rate of about 250 scfm/ft.

In another aspect, the fluid medium is delivered to the workpiece at a flow rate of at least about 25 scfm/ft. In yet another aspect, the fluid medium is delivered to the workpiece at a flow rate of at least about 50 scfm/ft. In another aspect, the fluid medium is delivered to the workpiece at a flow rate of at least about 75 scfm/ft. In another aspect, the fluid medium is delivered to the workpiece at a flow rate of at least about 100 scfm/ft. In a further aspect, the fluid medium is delivered to the workpiece at a flow rate of at least about 125 scfm/ft. In another aspect, the fluid medium is delivered to the workpiece at a flow rate of at least about 150 scfm/ft. In yet another aspect, the fluid medium is delivered to the workpiece at a flow rate of at least about 175 scfm/ft. In still another aspect, the fluid medium is delivered to the workpiece at a flow rate of at least about 200 scfm/ft. In another aspect, the fluid medium is delivered to the workpiece at a flow rate of at least about 225 scfm/ft. In a further aspect, the fluid medium is delivered to the workpiece at a flow rate of at least about 250 scfm/ft. In another aspect, the fluid medium is delivered to the workpiece at a flow rate of at least about 275 scfm/ft. In yet another aspect, the fluid medium is delivered to the workpiece at a flow rate of at least about 300 scfm/ft. In still another aspect, the fluid medium is delivered to the workpiece at a flow rate of at least about 325 scfm/ft. In another aspect, the fluid medium is delivered to the workpiece at a flow rate of at least about 350 scfm/ft. In yet another aspect, the fluid medium is delivered to the workpiece at a flow rate of at least about 375 scfm/ft. In still another aspect, the fluid medium is delivered to the workpiece at a flow rate of at least about 400 scfm/ft. In another aspect, the fluid medium is delivered to the workpiece at a flow rate of at least about 425 scfm/ft. In yet another aspect, the fluid medium is delivered to the workpiece at a flow rate of at least about 450 scfm/ft. In another aspect, the fluid medium is delivered to the workpiece at a flow rate of at least about 475 scfm/ft. It will be understood that while various flow rates and ranges of flow rates are provided herein, other flow rates may be used in accordance with the present invention to achieve the desired results. Thus, numerous other flow rates and ranges thereof are contemplated hereby.

The fluid medium generally may be delivered to the workpiece at a pressure of from about 3 to about 20 inches of water column (in. WC). In one aspect, the fluid medium is supplied to the workpiece at a pressure of from about 5 to about 12 in. WC. In another aspect, the fluid medium is supplied to the workpiece at a pressure of from about 5 to about 8 in. WC. In yet another aspect, the fluid medium is supplied to the workpiece at a pressure of from about 9 to about 12 in. WC. In still another aspect, the fluid medium is supplied to the workpiece at a pressure of from about 3 to about 6 in. WC.

In another aspect, the fluid medium is supplied to the workpiece at a pressure of at least about 3 in. WC. In yet another aspect, the fluid medium is supplied to the workpiece at a pressure of at least about 4 in. WC. In yet another aspect, the fluid medium is supplied to the workpiece at a pressure of at least about 5 in. WC. In another aspect, the fluid medium is supplied to the workpiece at a pressure of at least about 6 in. WC. In yet another aspect, the fluid medium is supplied to the workpiece at a pressure of at least about 7 in. WC. In yet another aspect, the fluid medium is supplied to the workpiece at a pressure of at least about 8 in. WC. In yet another aspect, the fluid medium is supplied to the workpiece at a pressure of at least about 9 in. WC. In another aspect, the fluid medium is supplied to the workpiece at a pressure of at least about 10 in. WC. In yet another aspect, the fluid medium is supplied to the workpiece at a pressure of at least about 11 in. WC. It will be understood that while various pressures and ranges of pressures are provided herein, other pressures may be used in accordance with the present invention to achieve the desired results. Thus, numerous other pressures and ranges thereof are contemplated hereby.

If desired, the fluid may be directed at specific portions of the workpiece to localize the fluid flow where needed. Additionally, the fluid may be directed to one or more faces of the workpiece as needed to enhance the effect of the impinging fluid.

Either the workpiece or impingement device, or both, may be oscillated, rotated, or otherwise moved randomly or at a predetermined interval or intervals to achieve additional fluid media impingement and thereby increase the efficiency of the process. The workpiece or impingement device generally may be moved at a rate or velocity up to about 40 ft/min. In one aspect, the workpiece or impingement device may be oscillated, rotated, or otherwise moved at from about 0.5 to about 5 ft/min. In still another aspect, the workpiece or impingement device may be oscillated, rotated, or otherwise moved at from about 5 to about 10 ft/min. In yet another aspect, the workpiece or impingement device may be oscillated, rotated, or otherwise moved at from about 10 to about 15 ft/min. In another aspect, the workpiece or impingement device may be oscillated, rotated, or otherwise moved at from about 15 to about 20 ft/min. In still another aspect, the workpiece or impingement device may be oscillated, rotated, or otherwise moved at from about 20 to about 25 ft/min. In yet another aspect, the workpiece or impingement device may be oscillated, rotated, or otherwise moved of from about 25 to about 30 ft/min. In another aspect, the workpiece or impingement device may be oscillated, rotated, or otherwise moved of from about 30 to about 35 ft/min. In a further aspect, the workpiece or impingement device may be oscillated, rotated, or otherwise moved at from about 35 to about 40 ft/min. It will be understood that while various rates of movement and ranges thereof are provided herein, other rates of movement may be used in accordance with the present invention to achieve the desired results. Thus, numerous other rates and ranges thereof are contemplated hereby.

Where the workpiece or impingement device is oscillated, the workpiece or impingement device may be displaced a distance of, for example, from about 3 to about 36 inches in each direction it travels. In one aspect, the workpiece or impingement device is displaced a distance of from about 3 to about 5 inches in each direction it travels. In another aspect, the workpiece or impingement device is displaced a distance of from about 7 to about 10 inches in each direction it travels. In yet another aspect, the workpiece or impingement device is displaced a distance of from about 10 to about 15 inches in each direction it travels. In another aspect, the workpiece or impingement device is displaced a distance of from about 15 to about 20 inches in each direction it travels. In still another aspect, the workpiece or impingement device is displaced a distance of from about 20 to about 25 inches in each direction it travels. In yet another aspect, the workpiece or impingement device is displaced a distance of from about 25 to about 30 inches in each direction it travels. In another aspect, the workpiece or impingement device is displaced a distance of from about 30 to about 36 inches in each direction it travels. While numerous displacement distances are provided herein, it will be understood that the workpiece or impingement device may be displaced any distance needed to achieve the desired results, for example, a distance substantially equal to a dimension of the workpiece. Thus, numerous other displacement distances are contemplated hereby.

The time required to complete an oscillation cycle generally may be from about 2 seconds to about 10 minutes. In one aspect, the oscillation cycle is from about 5 seconds to about 1 minute. In another aspect, the oscillation cycle is from about 2 to about 20 seconds. In yet another aspect, the oscillation cycle is from about 20 to about 40 seconds. In still another aspect, the oscillation cycle is from about 40 seconds to about 1 minute. In another aspect, the oscillation cycle is from about 1 to about 3 min. In yet another aspect, the oscillation cycle is from about 3 to about 6 min. In still another aspect, the oscillation cycle is from about 6 to about 10 min. While particular oscillation cycle times are provided herein, it will be understood that other oscillation cycles may be used as needed to achieve the desired results. Thus, numerous other oscillation cycle times are contemplated hereby.

The temperature of the fluid medium used in accordance with the present invention generally may be from about 400° C. to about 600° C. In one aspect, the temperature of the fluid medium is from about 450° C. to about 550° C. In another aspect, the temperature of the fluid medium is from about 490° C. to about 540° C. In yet another aspect, the temperature of the fluid medium is from about 425° C. to about 600° C. In still another aspect, the temperature of the fluid medium is from about 475° C. to about 575° C. In another aspect, the temperature of the fluid medium is from about 450° C. to about 500° C. In yet another aspect, the temperature of the fluid medium is from about 500° C. to about 550° C. While particular temperatures are provided herein, it will be understood that other temperatures may be used as needed to achieve the desired results. Thus, numerous other fluid medium temperatures are contemplated hereby.

As shown in FIG. 3, where the workpiece is formed in a sand mold with or without a core, as portions of the mold and/or core/(s) dislodge and fall from the workpiece, the pieces are collected in a hopper 222 for subsequent reclamation and reuse, for example, as discussed above.

Figure 5:
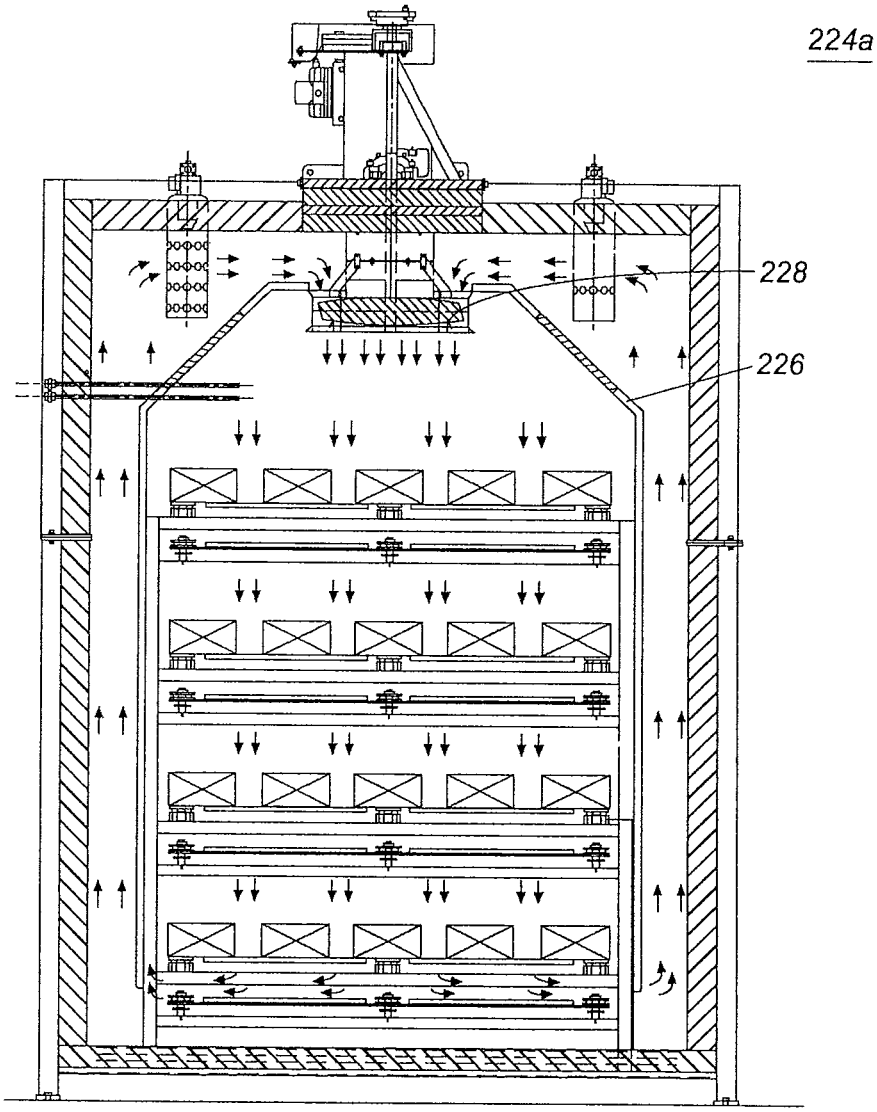
FIG. 5 is a cross-sectional view of the exemplary age oven of FIG. 2 taken along a line C-C.

Returning to FIG. 2, the furnace 210 and/or age oven 212 also may include one or more "soak zones" 224*a*, 224*b*, 224*c* that employ a conventional air recirculation system. For example, the furnace may include one more heat-up zones followed by one or more soak zones. FIG. 5 illustrates an exemplary "soak zone" with a conventional mass flow system with a baffle 226 and recirculating fan 228 system that may be used after the heat-up zone.

FIGS. 6-10 depict an alternate exemplary post-pour processing system 300 according to the present invention. The system of FIG. 6 includes components structured and functioning in accordance with the discussion of FIGS. 2-5, for example, a plurality of furnaces 310, age ovens 312, and coolers 313. However, the layout of the various components differs from that of FIG. 2.

Figure 6:
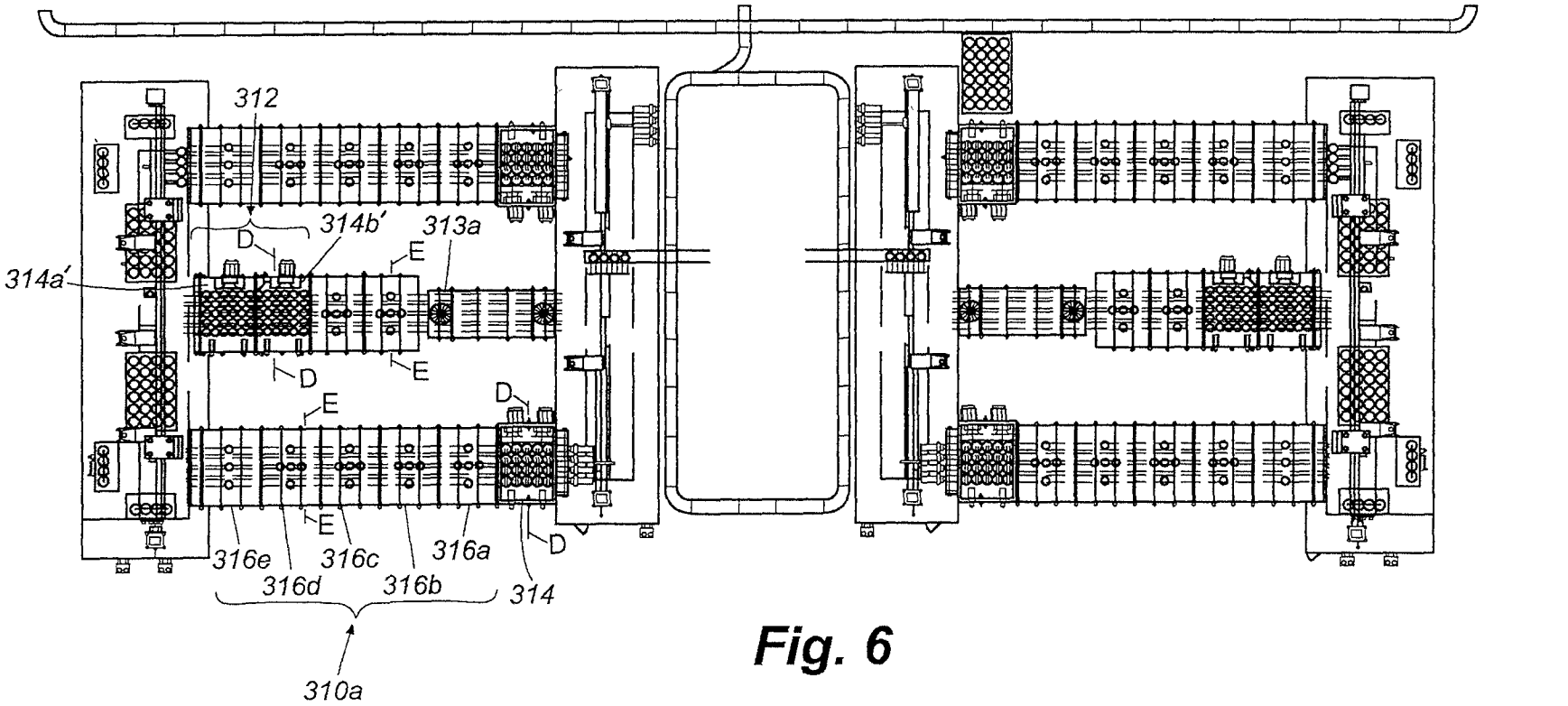
FIG. 6 is a top plan view of an another exemplary system according to the present invention.
Figure 7:
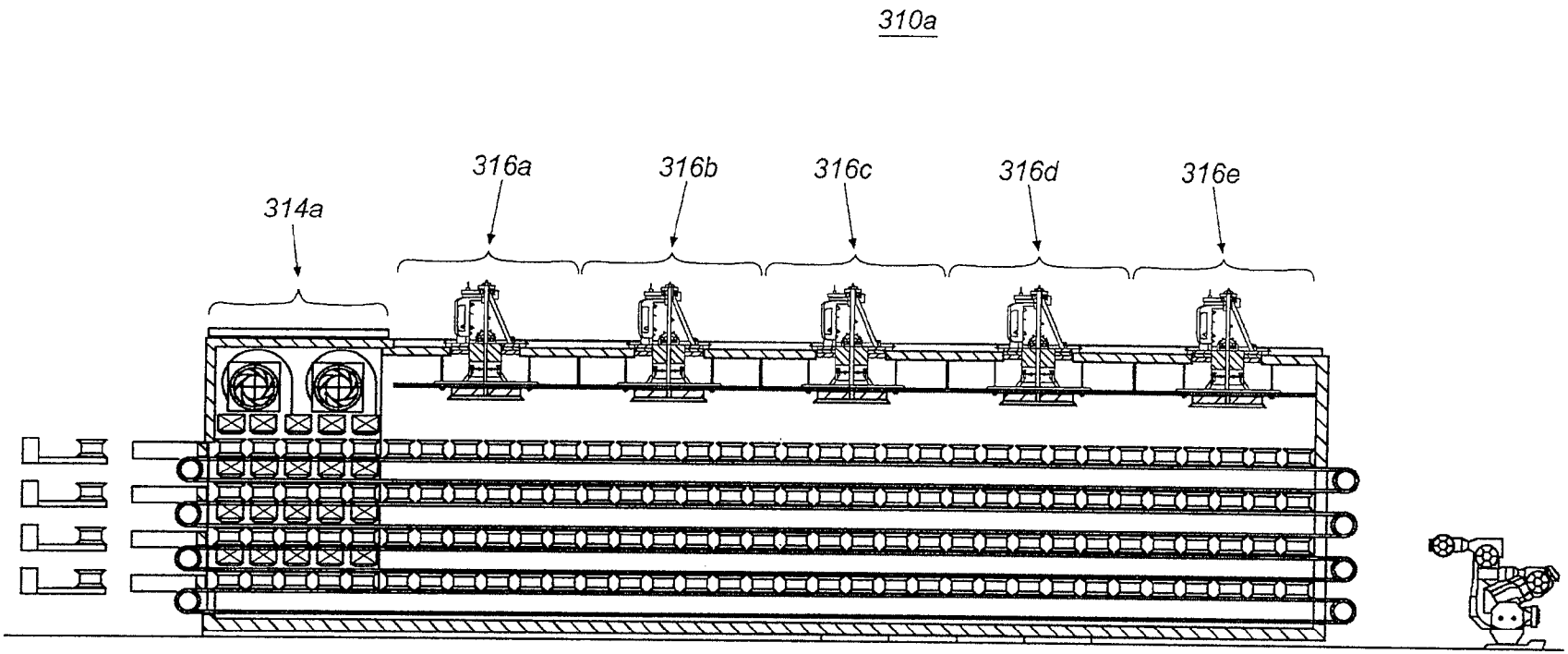
FIG. 7 is a cross-sectional view of the exemplary furnace depicted in FIG. 6.
Figure 8:
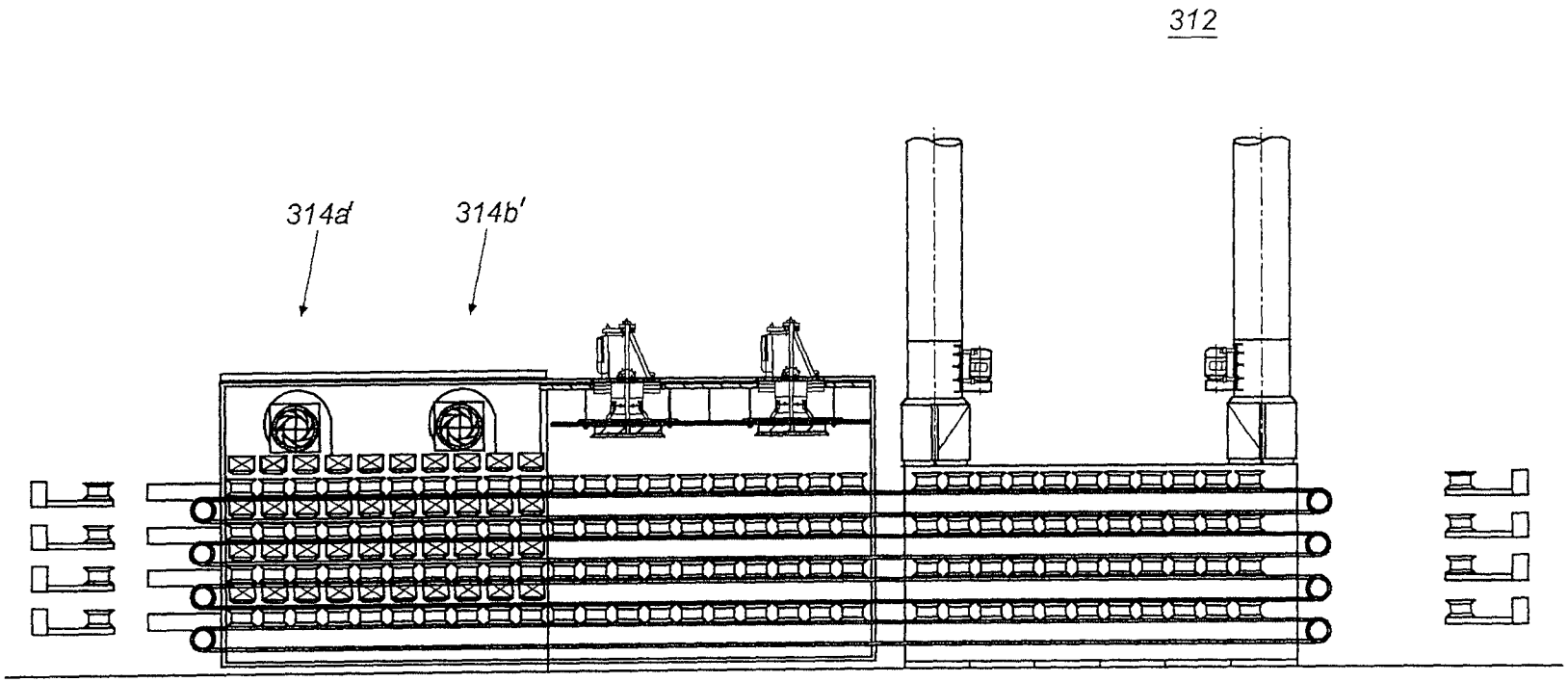
FIG. 8 is a cross-sectional view of the exemplary age oven and cooler depicted in FIG. 6.
Figure 9:
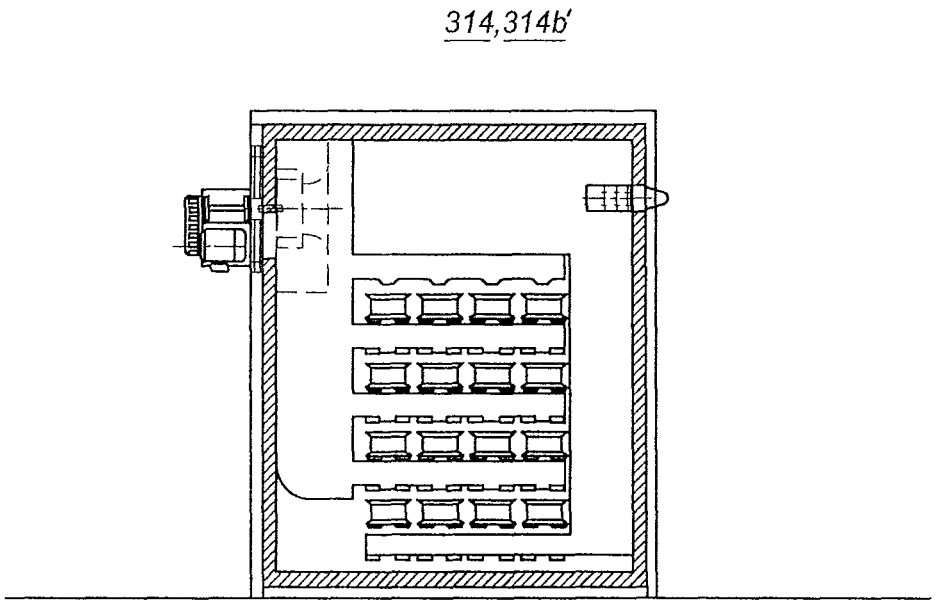
FIG. 9 is a cross-sectional view of the "heat-up" zone of the furnace of FIG. 6 taken along a line D-D.
Figure 10:
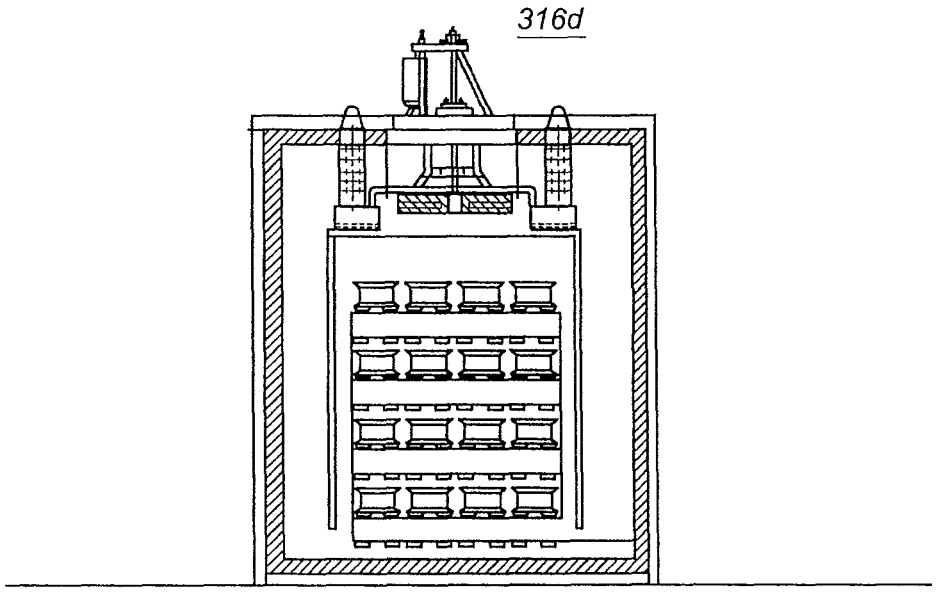
FIG. 10 is a cross-sectional view of the "soak" zone of the furnace of FIG. 6 taken along a line E-E.

The exemplary system of FIG. 6 is shown with a heat-up zone 314 and soak zones 316*a*, 316*b*, 316*c*, 316*d*, 316*e* in the heat treatment furnace 310, and heat-up zones 314*a*', 314*b*' in the age oven 312. The system shown in FIGS. 6-10 may be employed, for example, where the workpiece is formed without using a sand mold, or where the mold and cores are removed before entering the heat treatment furnace. While a sand mold collection hopper, such as that shown as element 222 in FIG. 3, would not be required, the system may include such a hopper to be able to accommodate workpieces that are formed with a sand mold.

Figure 11:
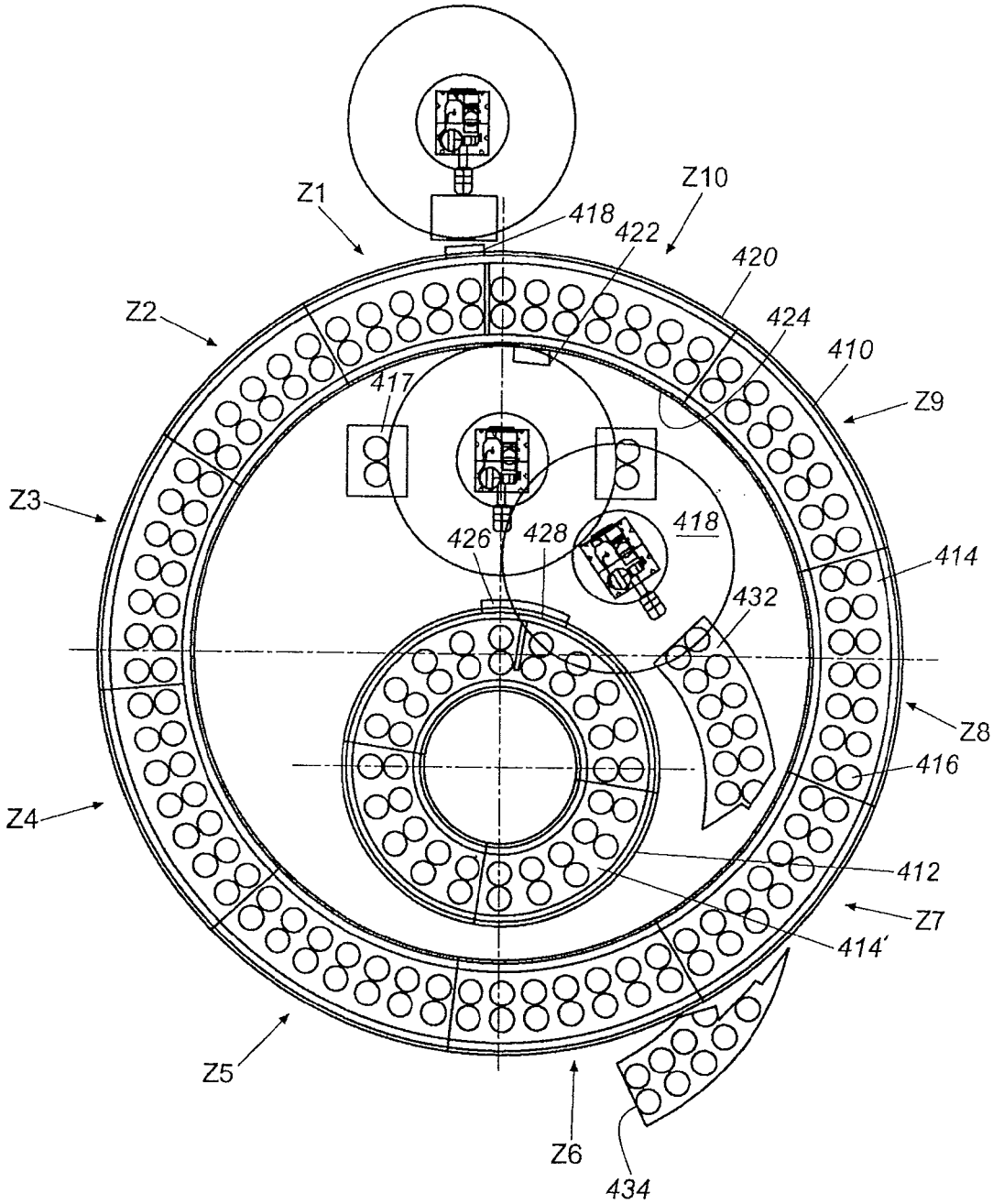
FIG. 11 is a top plan view of an exemplary rotary post-pour processing system that may be used in accordance with the present invention.

It will be understood by those skilled in the art that while the present invention has been shown and described in connection with a linear (straight line) flow furnace, other furnace and oven designs may be used. For example, as shown in FIGS. 11-14, the present invention may be used with a "rotary" processing system. As shown in FIG. 11, a rotary furnace system 400 generally comprises a heat treatment furnace 410 and an age oven 412, each including a rotatable hearth 414, 414' for supporting and moving the workpieces 416. The furnace 410 typically includes an entrance opening 418 in the outer peripheral wall 420 to allow the workpieces 416 to be placed into the furnace 410, and an exit opening 422 on the inner periphery wall 424. If desired, the entrance opening 418 may be adjacent the pouring station (not shown) to minimize heat loss during transfer to the furnace 410. Each rotary furnace and oven may be connected to another rotary furnace, oven, or other processing station by a robotic means or other transfer conveyance system. In one aspect, the robotic means or conveyance system places the components in a set and/or registrable position in each rotary furnace or oven.

The workpieces are moved within the rotary heat treatment furnace 410 and age oven 412 by rotating the hearth 414*a*, 414*b* within the annular chamber. The hearth may be rotated either continuously or through indexing positions, or may be halted to receive or discharge parts. Further, the hearth may be halted to oscillate the workpiece (or the nozzle) for a duration sufficient to allow the fluid media to traverse the surface of the workpiece and to aid in the efficiency of the process.

To facilitate movement, the hearth is supported on, for example, wheels that run on a circular track on the underside of the hearth. The hearth is moved, for example, by a gear driven actuator that pushes or pulls the hearth along a planetary gear (ratcheting mechanism). The drive mechanism may include speed controls to adjust hearth movement for acceleration, normal running speed, and deceleration, and may be used to oscillate the hearth to achieve additional fluid media impingement from the internal nozzles of the furnace and oven to the components. A seal may be provided along the movable hearth and the inner and outer walls of the furnace to prevent leaking of the heat or fluid.

Figure 13:
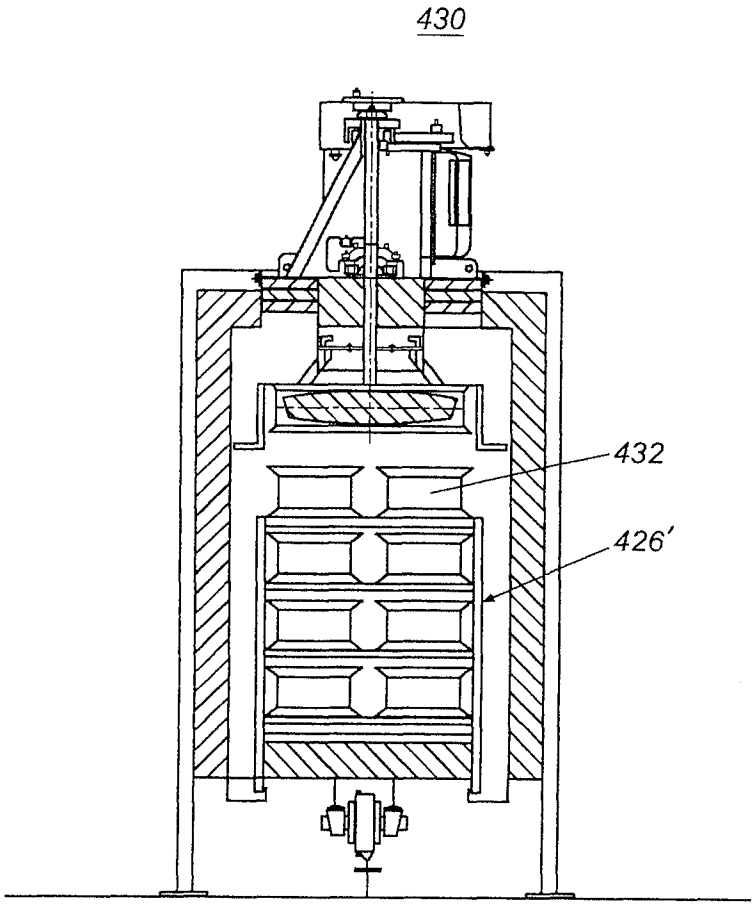
FIG. 13 is a cross-sectional view of an exemplary soak zone of the heat treatment furnace or age oven of FIG. 11.
Figure 12:
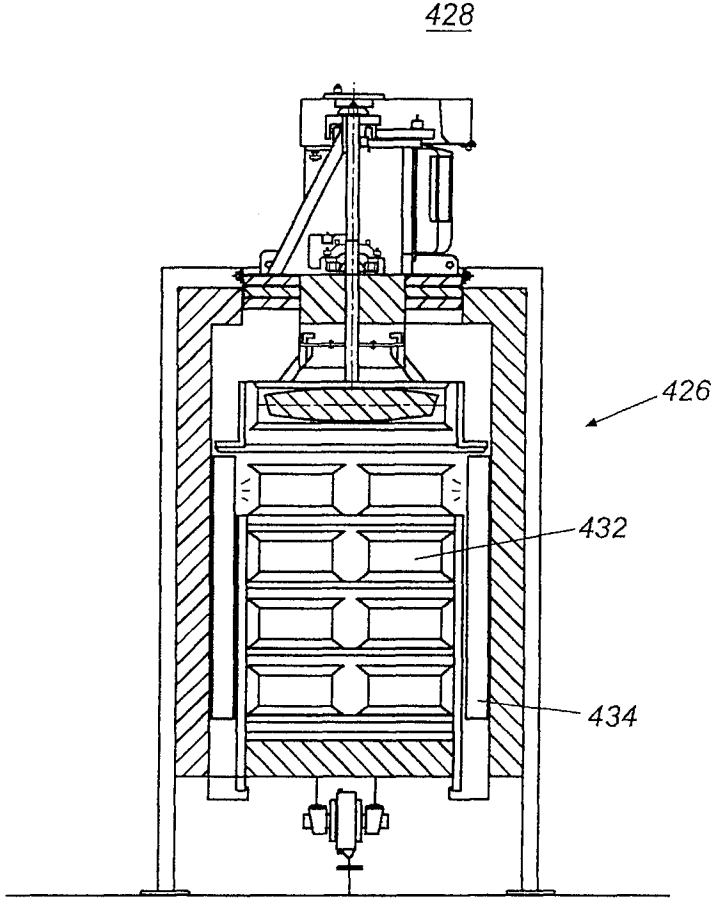
FIG. 12 is a cross-sectional view of an exemplary heat-up zone of the heat treatment furnace or age oven of FIG. 11.

As shown in FIGS. 12 and 13, the moveable hearth may include, for example, a racking or shelving system 426, 426' to allow multiple levels of workpieces to be loaded and processed through the system. Once the workpieces are loaded in the rack system, they are transported through the furnace on the rack system in an angular (circular) movement (0 degrees up to 360 degrees) on a path concentric with the circumference of the respective furnace or age oven. One or more pushers, actuators, or drives may be used to move the rotary hearths.

The heat treatment furnace 410 and/or age oven 412 may include one or more heat-up zones 428 and one or more soak zones 430. The heat-up zone(s) and soak zone(s) may have a similar configuration to those described above, or may be configured in any other suitable manner that provides direct impingement of a fluid onto each workpiece. FIG. 12 illustrates a plurality of workpieces 432 in an exemplary heat-up zone 428 of the heat treatment furnace or age oven 412 of FIG. 11. Air nozzles 434 are positioned in close proximity to the workpieces 432 to impinge air or another fluid directly on the workpieces. FIG. 13 illustrates a plurality of workpieces 432 in an exemplary soak zone 430 of the heat treatment furnace 410 or age oven 412 of FIG. 11.

Figures 14A, 14B, 14C:
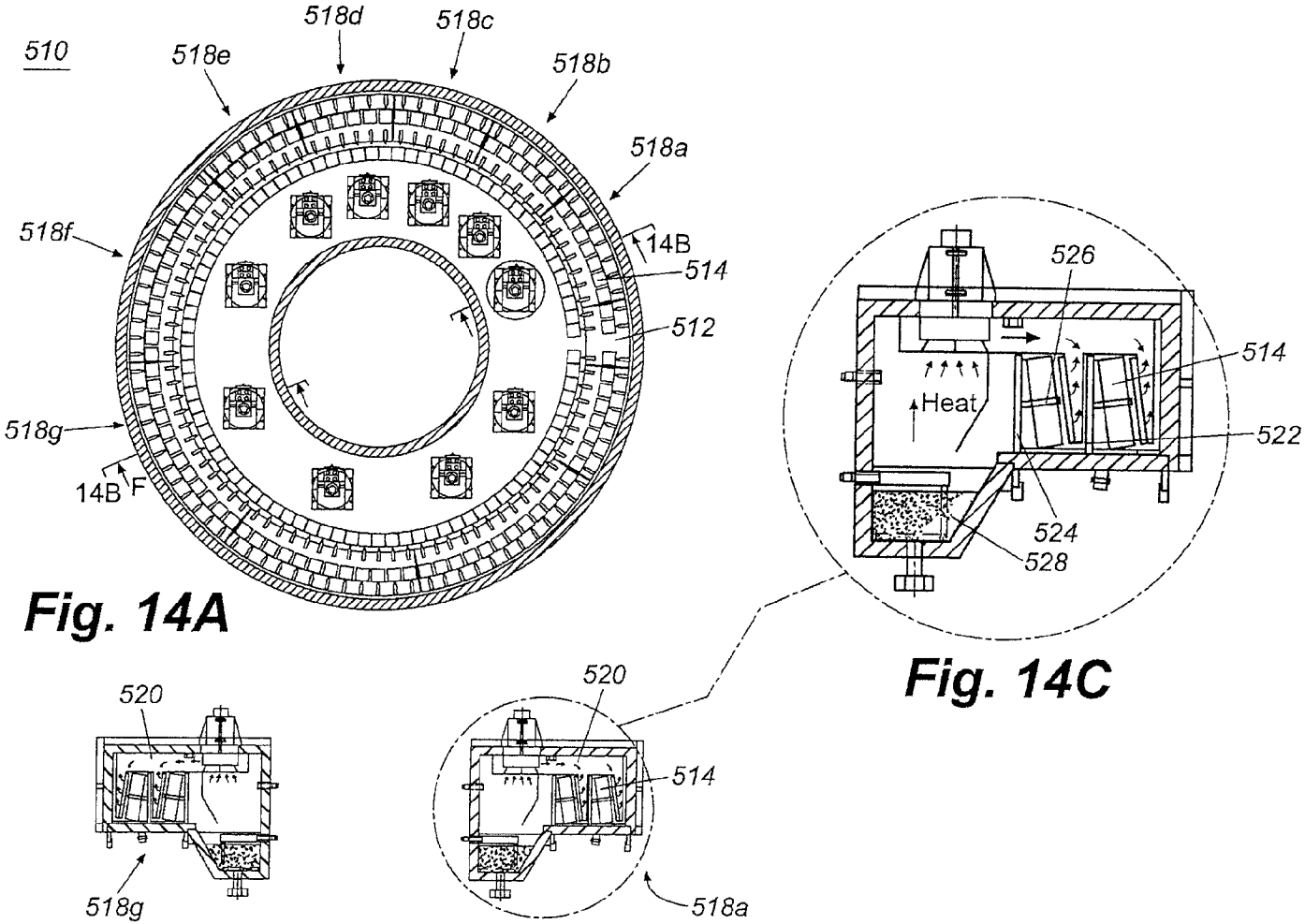
FIG. 14*a* is a top plan view of another exemplary rotary heat treatment furnace that may be used in accordance with the present invention.
FIG. 14*b* is a cross-sectional view of the furnace FIG. 14*a* taken along a line F-F.
FIG. 14*c* is an enlarged view of one of the exemplary heating zones of FIGS. 14*a* and 14*b;*

FIGS. 14*a*-14*c* depict another exemplary rotary heat treatment furnace that may be used in accordance with the present invention. The furnace 510 includes an opening 512 through which the workpieces 514 enter and exit, and a rotatable hearth 516 for supporting and moving the workpieces 514 through the various zones until heat treatment is complete and the workpiece is removed. The furnace 510 depicted in FIG. 14*a* includes a plurality of heating zones 518*a*, 518*b*, 518*c*, 518*d*, 518*e*, 518*f*, 518*g*. As shown in FIG. 14*b*, the various zones each are configured in a similar manner and include a source of fluid, for example, air, that is directed through a duct 520 and impinged upon portions of the workpieces 514, similar to a heat-up zone as described above. However, one or more zones, for example, zones 518*a*, 518*b*, may be operated at a greater temperature as needed to achieve the desired heat treating results. As best seen in FIG. 14*c*, the workpieces 514 may be placed into a shelving system 522, such as that shown, in which the vertical 524 and/or horizontal supports 526 for the workpiece 514 are formed from a permeable material, for example, grating or mesh. Where applicable, as pieces of sand mold and/or core fall from the workpieces, the flow of air sweeps the particles into a stationary fluidized bed 528 for further combustion. Heat from the fluidized bed 528 is drawn into the air system and used to impinge the surface of the workpieces.

Optionally, the furnace and/or age oven include features that permit the workpiece to be rotated and/or inverted to bring various faces or surfaces of the workpiece in closer proximity to the duct or nozzles. Additionally, by inverting the workpieces, any loose sand and binder material (where used), is able to fall from the workpiece.

In one aspect, the shelving or stacking system includes a rotating mechanism at least partially within the furnace that includes a clamp or other mechanism (not shown) that attaches to the workpiece. If desired, the clamp may be attached to the riser to prevent damage to the workpiece. The clamp may be attached to a mechanical device that lifts and inverts the workpieces within the saddles. In doing so, any loose sand from the core is able to fall from the workpiece. The workpieces may be rotated or at a predetermined time, or at predetermined intervals, to promote heat treatment and/or removal of the core from the workpiece.

In another aspect, the furnace includes at least one claw or other gripping device for handling the workpiece. The claw may include a plurality of mechanical "fingers" that contact and apply sufficient pressure to the workpiece to allow the workpiece to be raised and maneuvered to position the workpiece within the furnace. Additionally, the claw may include features that allow the workpiece to be gripped and inverted to permit loose sand from the core to fall from the workpiece. The claw may be used to grip the entire workpiece, or may be used to grip the workpiece by, for example, the riser. Where applicable, as the binder is combusted and the mold and core fall away from the workpiece, the claw may be provided with features that automatically tighten the grip on the workpiece. The claw may be robotic and may be programmed to move the workpieces one at a time at a desired heat treatment time or temperature. The claw also or alternatively may be operated manually through electronic controls, so that an operator can manually maneuver a specific workpiece if needed or desired.

In yet another aspect, the workpiece is placed into a saddle prior to entering the furnace. The saddle generally may be a basket or carrier formed from a metal material and having a base and a series of side walls that define a chamber or receptacle in which the workpieces are received with the core apertures or access openings exposed. The saddle may include a device for securing the workpiece, so the workpiece within the saddle can be rotated and inverted to permit loose core material to fall from the workpiece. The device for securing the workpiece may be any suitable device as desired, for example, a bracket, clamp, tie, strap, or any combination thereof. Other devices for securing the workpiece within the saddle are contemplated hereby.

Optionally, in any of the aspects described herein or contemplated hereby, a shacking or vibrating mechanism may be provided to assist further in the removal of loose core material from the workpiece. In one variation, the shacking or vibrating mechanism is directed at a riser on the workpiece, thereby minimizing or preventing damage to the workpiece.

Returning to FIG. 11, when the workpieces 416 are ready to be removed, another robotic means or transfer conveyance system may be used to transfer the workpiece to a quench station or unit 417, which may be located in the central open area 418 surrounded by the furnace 410 proximate the exit opening 422. In one aspect, the quench medium may be air delivered to the workpiece, for example, at a velocity of from about 10 to about 500 feet per second (ft/s), for example, about 200 ft/s. In another aspect, the quench medium may be water delivered to the workpiece, for example, at a velocity up to about 50 ft/s, for example, at about 10 ft/s. In yet another aspect, the quench medium may be still water (velocity of 0 ft/s). In still another aspect, a combination of quench mediums may be used. Other quench mediums and velocities are contemplated hereby.

After the quenching process is complete, another (or the same) robotic means 424 or transfer conveyance system may be used to place the workpiece(s) 416 into the rotary age oven 412 that also may be located in the central open area 418 surrounded by the furnace 410. The rotary age oven 412 is similar to the rotary heat treatment furnace 410 except that the entry and exit openings 426, 428 may be on the same periphery (inner or outer walls). Additionally, the diameter of the age oven typically is less than that of the furnace. However, the relative size of the rotary heat treatment furnace and rotary age oven may vary for a given application. For example, to accommodate an aging time longer than the heat treatment time (for example, 30 to 60 minutes of heat treatment and 3 hours of aging), the rotary age oven may be larger in circumference than the rotary heat treatment furnace.

Another robotic means or transfer conveyance system 430 may be used to remove the workpieces 416 from the age oven 412 and place them into a cool unit 432 to finalize the heat treatment process. The cool unit uses, for example, circulating air blown around the workpieces as the workpieces move on a roller hearth or belt conveyor through a chamber. Cooling is continued until the temperature of the workpiece is reduced sufficiently to be handled by plant personnel. In one aspect shown in FIG. 11, the cool unit 432 opening is located adjacent the age oven 412 and may follow a spiral path outside of the rotary heat treatment furnace such that the exit 434 is outside the peripheral walls of the rotary heat treatment furnace 410. The direction of travel of the cool unit may spiral either downward (to below) or upward (to above) the rotary heat treatment furnace as desired. For example, the cool unit is depicted as defining a curved, downwardly spiraling path from the inside to the outside of the furnace.

Optional Sand Reclamation Feature

As previously stated herein, where a sand mold and/or core are used, the sand may be removed and reclaimed at various points throughout the process. A sand scrubber also may be utilized to remove particles of ash or other foreign particles from the sand before reuse. Examples of sand reclaiming systems are provided in U.S. Pat. Nos. 5,350,160, 5,565,046, 5,738,162, and 5,829,509 and U.S. patent application Ser. No. 11/084,321 for "System for Heat Treating Castings and Reclaiming Sand", filed Mar. 18, 2005, each of which is incorporated by reference herein its entirety. Examples of other systems for heat treating castings, removing sand cores, and reclaiming sand are provided in U.S. Pat. Nos. 5,294,094, 5,354,038, 5,423,370, 5,829,509, 6,336,809 and 6,547,556, each of which is incorporated herein by reference in its entirety.

One specific example of a sand reclamation system is discussed in detail below. However, any suitable sand reclaiming and/or scrubbing system may be used with various aspects of the present invention. Further, the method and system for reclaiming refined sand may be implemented independently, or may be integrated into other metal processing components, for example, a heat treatment furnace, core removal unit, and so on.

Figure 15:
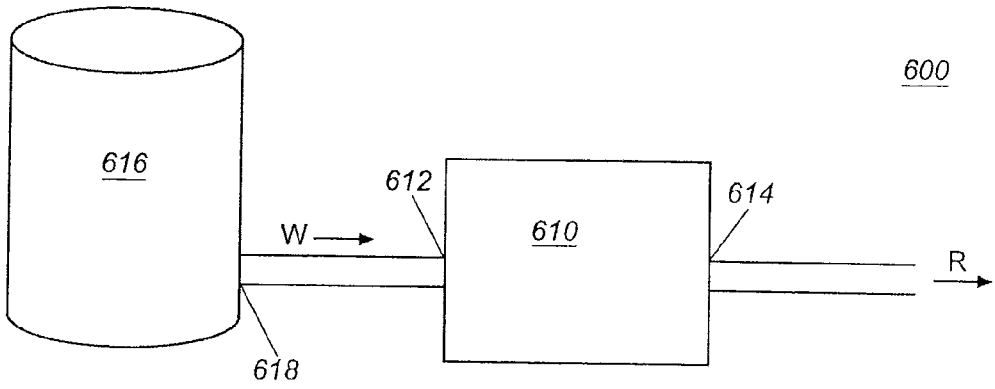
FIG. 15 is a schematic view of an exemplary sand reclamation process that may be used with various aspects of the present invention.

FIG. 15 depicts one example of a system and method for reclaiming sand that may be used with various aspects of the present invention. In one example, a sand reclamation chamber or unit includes a heated, fluidized bed having a plurality of baffles and/or weirs that define a path through which waste sand travels. As the waste sand travels along the path, the binder is combusted and the sand is refined. The number and length of the baffles, the flow rate through the fluidized bed, the temperature, and other system variables may be specified to attain the desired degree of refinement of the sand.

The system 600 includes a chamber 610 having an inlet 612 and an outlet 614. The waste sand W is provided to the chamber through the inlet. The waste sand may be charged directly from another process unit or step, or may be collected and stored prior to reclamation. For example, the waste sand W may be stored in a sand reservoir 616 designed to receive and store dry, mostly granulated waste sand from the sand system(s) of the facility. The reservoir may have various specifications and features. For example, the waste sand reservoir may be a cylindrical bin about ten feet in diameter with straight sides of about eighteen feet in length, which can store about forty five metric tons of sand. The reservoir may be designed with anti-segregation features (not shown), such as chambers or baffles, that reduce or eliminate separation and discharge of non-uniform sand grain distributions. The reservoir may include a top safety rail, an access hatch, a sand receiver flange, an exhaust flange, an internal safety ladder, roof access, and sand level indicators (not shown). The discharge 618 from the reservoir 616 can include a maintenance slide gate and dual flap valve metering devices (not shown). The waste sand can be metered from the waste sand reservoir at an adjustable rate of, for example, up to about 20 metric tons per hour.

The chamber 610 is provided with a heating element to combust the binder material contained in the waste sand. Any heating element, for example, a radiant heating element, may be used to provide heat to the system. Generally, the temperature of the fluidizing media is maintained at a temperature at or above the combustion temperature of the binder, typically from 250° C. to about 900° C. Thus, in this and other aspects, the temperature of the fluidizing media may be from about 490° C. to about 600° C. As the fluidized waste sand particles move along a circuitous path defined by a plurality of baffles and, optionally, weirs, the binder is combusted and the sand is refined. The circuitous path may have any length as needed or desired to achieve the desired results. For example, in this and other aspects, the path may have a length of from about 5 meters to about 15 meters, for example, about 10 meters. A fluidizing air distributor (not shown) may be used to improve the uniformity of the flow of the fluidizing media. Further, the particles may be urged through the housing a fluidizing blower (not shown) operated at a flow rate of, for example, about 2300 $Nm^3/h$. The residence time of the waste sand in the chamber is sufficient to substantially refine, clean, and otherwise reclaim the sand before it exits the chamber through an outlet. For example, in this and other aspects, the residence time within the chamber may be from about 30 min. to about 60 min. The substantially refined sand R may be collected or stored in any manner known to those of skill in the art. In this and other aspects, the system may produce from about 10 tons/h to about 20 tons/h, for example, about 15 tons/h of refined sand.

As another example, an integrated sand core removal and reclamation system may be provided. The system may include a core removal unit including at least one chamber though which a casting is moved for removal of a sand core therefrom. Any method of scoring, breaking, chiseling, shattering, eroding, blasting, or dislodging (collectively "removing") the core may be used as desired, for example, those described in U.S. Pat. Nos. 5,565,046, 5,957,188, and 5,354,038, each of which is incorporated by reference herein in its entirety.

As the core is removed from the casting, the pieces of waste sand are directed by gravity feed or otherwise to a sand reclamation chamber. The sand reclamation chamber includes a fluidized bed in flow communication with the core removal unit and a plurality of baffles defining a circuitous path through the fluidized bed. The fluidized bed is heated to a temperature that is at or above the combustion temperature of the binder. As the sand moves along the circuitous path, the binder is combusted and the sand is refined. The refined sand may be collected and stored in any manner known to those of skill in the art.

Optionally, waste sand from a sand reservoir also may be provided to the reclamation system for concurrent processing with the waste sand generated by core removal.

Figure 16:
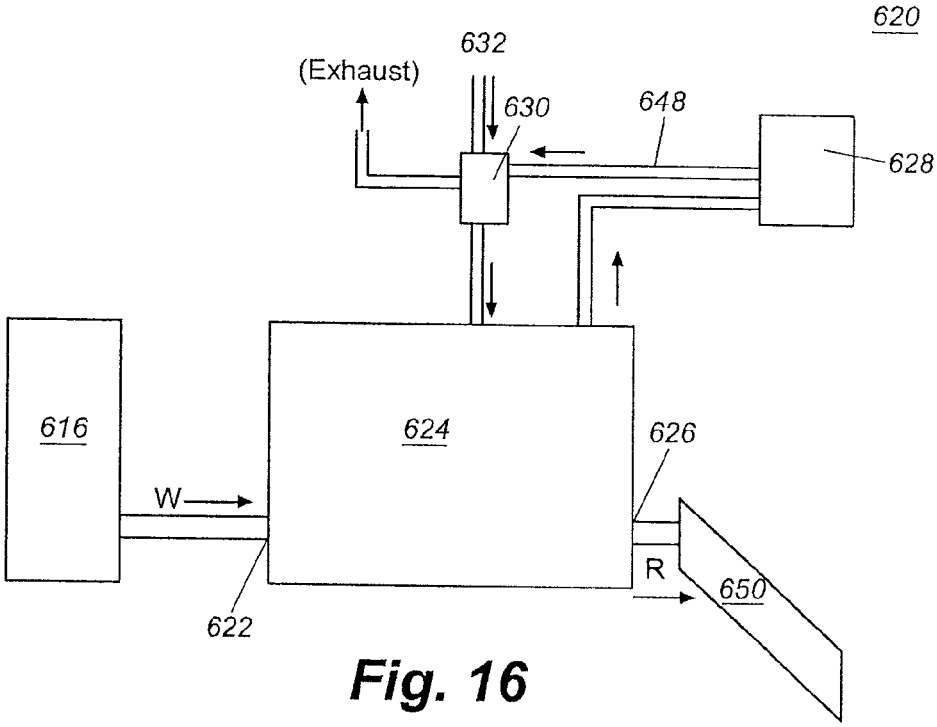
FIG. 16 is a schematic view of an exemplary integrated core removal and sand reclamation system in which the core removal unit comprises a furnace.

FIG. 16 depicts an exemplary integrated core removal and sand reclamation system in which the core removal unit comprises a furnace. The system 620 optionally includes a waste sand reservoir 616 in flow communication through an inlet 622 of a furnace 624. The furnace 624 defines at least one heating chamber through which castings (not shown), such as engine blocks and cylinder heads, are processed for heat treatment, sand core material removal, and sand reclamation. Waste sand W charged into the furnace 624 from the waste sand reservoir 616 can be cleaned, reclaimed, and otherwise refined in the chamber and directed through the outlet 626 for storage or further processing. Additionally, as waste sand is generated from the core removal process, it also may be processed by the sand reclamation system. Alternatively, some or all of the waste sand generated from the core removal process may be collected and stored for later processing.

The system 620 may include an incinerator 628 in flow communication with the chamber of the furnace 624. The system 620 also may include a heat exchanger 630 in flow communication with the incinerator 628, a source of fluidized air 632, and the chamber of the furnace 624. Heat from the incinerator 628 may be used to heat the fluidizing air and/or heat the interior of the chamber of the furnace 624.

Figure 17:
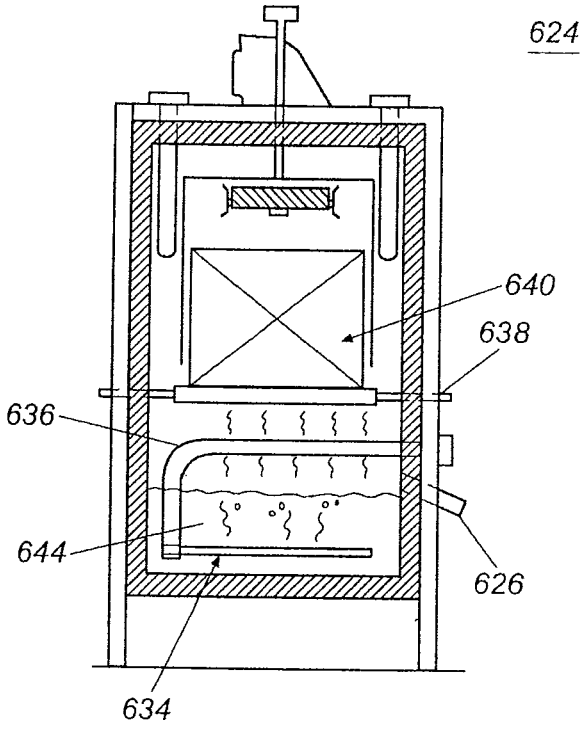
FIG. 17 is a cross sectional view of the furnace shown in FIG. 16.
Figure 18:
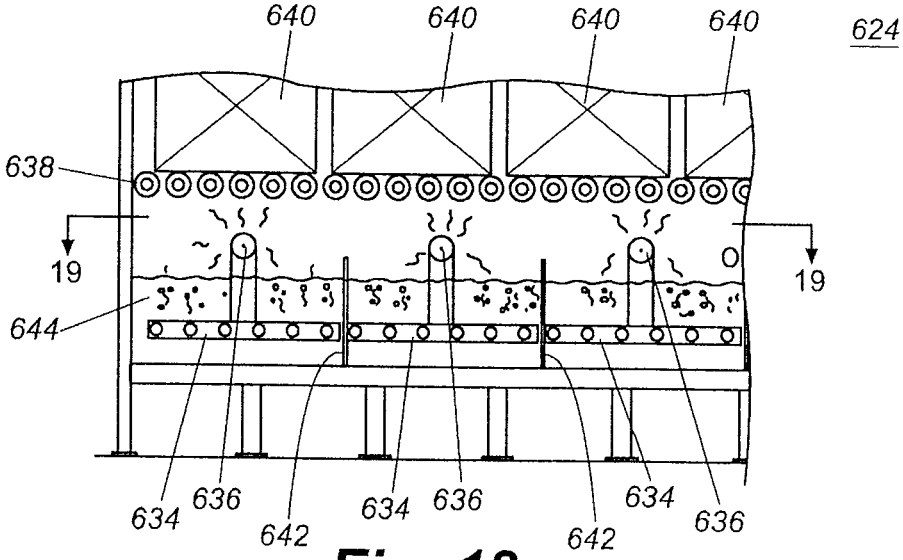
FIG. 18 is another cross-sectional view of a portion of the furnace shown in FIG. 16.
Figure 19:
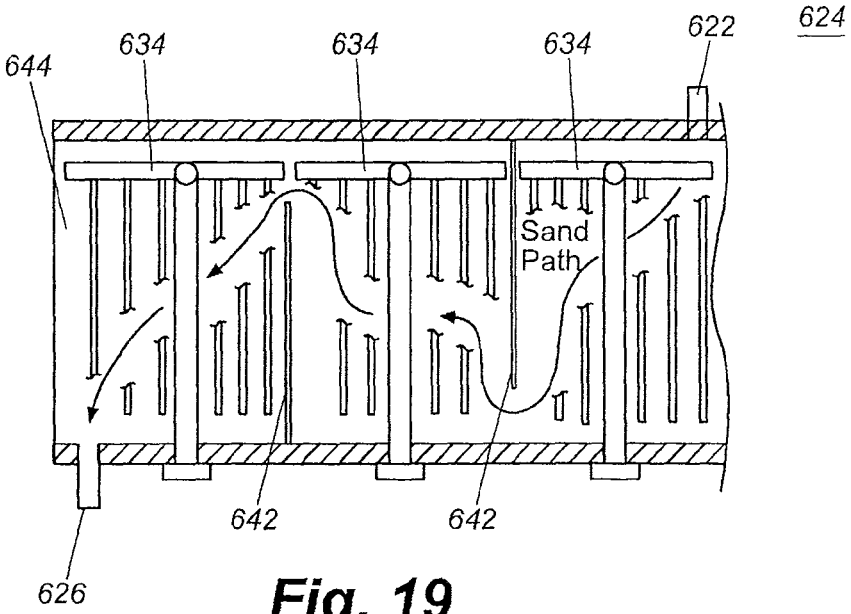
FIG. 19 is a cross-sectional view of the furnace in FIG. 18 taken along line 19-19.

Turning to FIGS. 17-19, the furnace 624 may include a complement of fluidizing air distributors 634 and/or heating elements, for example, radiant tube heaters 636, located below a roller hearth 638 on which castings 640 are transported through the furnace 624. One or more weirs and baffles 642 are disposed in the lower section of the furnace 624 within the area of the fluidized bed 644. The baffles 642 define a circuitous path through which waste sand must travel to exit through sand outlet 626. The residence time of the waste sand in the furnace 624 is sufficient to refine, clean, and otherwise reclaim the same before it exits the furnace 624. In one aspect, the furnace 624 is a Number One or Number Two Sand Lion® lower furnace module available from Consolidated Engineering Corporation of Kennesaw, Ga. However, it should be understood that any other suitable furnace may be used in accordance with the present invention.

The fluidizing heating system provided in the furnace 624 includes one or more heating elements 646, which are shown as radiant heating tubes in FIGS. 17-19. The heating elements 646 supplement addition of heat into the furnace 624 heating zones, and compensate at least partially for heat lost during opening of the furnace door and addition of cooler castings 640. The fluidizing heating system may also provide radiant heating directly to the lower level of castings 640. Generally, the fluidizing temperature can be the same as the furnace heating temperature. The fluidizing system also can include a fluidizing blower (not shown) to provide pressurized air to the fluidizing distributors 634.

The furnace exhaust air incinerator 628 (FIG. 16) may be any suitable incinerator, as will be appreciated readily by those of skill in the art. For example, the incinerator may be operated at up to about 825° C. for about a 1.0-second resident time to burn carbon monoxide and volatile organic compounds to an acceptable level for discharge to the atmosphere. In one aspect, the incinerator 628 has a capacity of about 6800 $Nm^3H$. In another aspect, the incinerator 628 includes sidewall insulation of about 200 mm thick 1260° ceramic fiber. In other aspects, the incinerator 628 includes a top-mounted burner with gas train and controls, an inspection door, or both, and other features known to those of skill in the art. Inner mixing baffles, an inlet profiling plate, or a combination there of may be used to attain sufficient velocity and turbulence in the incinerator.

Likewise, the heat exchanger 630 may be any suitable heat exchanger, as will be understood readily by those of skill in the art. The heat exchanger 630 may use heat from the incinerator 628 to heat at least partially the air to be used in the fluidizing system. Hot dirty gases generally enter the heat exchanger 630 from the incinerator connecting duct 648 and exit via an exhaust duct. In one aspect, the heat exchanger 630 is a U-tube type exchanger having overall dimensions of about 4000 mm by 2100 mm by 2100 mm high. In another aspect, the outer casing of the heat exchanger is steel plate with structural steel support, as well as other suitable materials. In another aspect, the insulation of the heat exchanger is castable MC25 backed with 75 mm mineral wool, and the roof insulation is ceramic fiber modules. In yet another aspect, the front rows of heat exchanger tubing are formed from Incoloy 800 HT, and the remaining rows SA-249-304L are formed from stainless steel. The tubing may be 35 mm OD with 2.1 mm average wall thickness. Process air tube bundle top manifolds may be a combination of 6 mm thick 304 stainless steel and carbon steel.

Reclaimed sand R is discharged from the outlet 626 to a hot sand inclined conveyor 650. The system 620 may produce from about 3 to about 10 tons/h, for example, about 5 tons/h, of sand from sand core material removed from castings processed in the furnace 624 and from about 5 to about 15, for example, about 10 tons/h, of waste sand from the reservoir 616, thereby having an overall production rate of from about 10 to about 20 tons/h, for example, about 15 tons/h, of refined sand.

The reclaimed sand can be combined with other sand in downstream process units in which the sand is pre-screened, final screened, and cooled. The various post-reclamation steps may have a total production capacity of from about 10 to about 20 tons/h, for example, 15 hours.

Example 1

The time required for various furnaces to reach a predetermined temperature was evaluated. The results are shown in Tables 1 and 2.

TABLE 1

| Run | System | Description | Approx. time to reach 932° F. |
|---|---|---|---|
| 1 | Sand Lion ® furnace (Dock module) | Single level roller hearth Sand Lion ® furnace, roof mounted 38 in. vertical shaft CEC axial fan, air flow through the load and up the sides, roof mounted vertical radiant tubes in the return air, tapered floor with hot air fluidizer | 75 min |
| 2 | DFP (Small test DFB) | Sand bed about 3 cubic feet with hot air fluidizer | 60 min |
| 3 | HP furnace | Single level roller hearth Sand Lion ® furnace, roof mounted 40 in. vertical shaft radial fan, air flow directed through side plenums to nozzles above and below the load with nozzle discharge velocity at about 10,000 feet per minute, two side mounted direct fired burners discharging into fan inlet, tapered floor with hot air fluidizer | 40 min |
| 4 | Experimental furnace - Close Proximity Heat Treating (CPHT) Furnace | Single casting unit with one nozzle above and below the casting, 26 in. long slot nozzles positioned about 2 in. from the casting, nozzle discharge velocity about 10,000 ft/min, casting able to oscillate under the nozzle(s), casting placed with deck face down and risers up, external heater box used to heat the nozzle air to required temperature, unit internal dimensions about 3 cubic feet | 35 min |

TABLE 2

| Run | System | Approx. time to reach 1000° F. |
|---|---|---|
| 5 | HP furnace | 60 min |
| 6 | Experimental CPHT furnace | 40 min |

Example 2

The effect of various parameters on the time required to de-core a Manufacturer A 2-valve I-4 cylinder head casting (with the mold intact) was evaluated. The CPHT furnace described in Example 1 was used with a set point of 1000° F. The results are presented in Tables 3-5.

TABLE 3

Effect of Nozzle Air Flow Rate

| Run | Air flow rate (scfm) | Time required to de-core (min) |
|---|---|---|
| 7 | 620 | 35 |
| 8 | 300 | 100 |
| 9 | 450 | 45 |

TABLE 4

Effect of Nozzle Oscillation

| Run | Oscillation | Time required to de-core (min) |
|---|---|---|
| 10 | Casting oscillated about 12 in. in a direction perpendicular to the length of the nozzle at about 14 feet per minute | 35 |
| 11 | No oscillation | 60 |

TABLE 5

Effect of Nozzle Number and Position

| Run | Nozzle arrangement | Time required to de-core (min) |
|---|---|---|
| 12 | Both nozzles - each having ⅓ in. diameter opening, about 620 scfm | 35 |
| 13 | Upper nozzle only - ⅓ in. diameter opening, about 469 scfm | 80 |
| 14 | Alternate upper and lower every 5 minutes - each having a ⅓ in. diameter opening, about 469 scfm | 45 |

Example 3

The effect of temperature on the time required to de-core various workpieces was evaluated using the CPHT furnace described in Example 1. The results are presented in Table 6.

TABLE 6

| Run | Cylinder head | Furnace temp. set point (° F.) | Time required to de-core (min) |
|---|---|---|---|
| 15 | Manufacturer A 2-valve I-4 | 914 | 60 |
| 16 | Manufacturer B 4-valve v-6 | 914 | 110 |
| 17 | Manufacturer A 4-valve I-4 | 914 | 135 |
| 18 | Manufacturer A 2-valve I-4 | 932 | 60 |
| 19 | Manufacturer C diesel 4-valve | 932 | 200 |
| 20 | Manufacturer A 2-valve I-4 | 1000 | 35 |
| 21 | Manufacturer B 4-valve v-6 | 1000 | 60 |
| 22 | Manufacturer A 4-valve I-4 | 1000 | 80 |
| 23 | Manufacturer C diesel 4-valve | 1000 | 160 |

Example 4

Various process conditions were evaluated using the CHPT furnace described above. First, the sample cylinder head (including core(s)) was weighed. Two different types of cylinder heads were evaluated. Type R was a Manufacturer D 4-valve I-4 diesel cylinder head. Type S was a Manufacturer D 4.6L 4-valve cylinder head. Thermocouples were attached to each workpiece. Several holes having a ¼ in. (25 mm) diameter were drilled into the flash to promote de-coring. Each workpiece was preheated in the CPHT unit to a temperature of about 662° F. (350° C.) (except for Run 30, which was not preheated).

Next, each workpiece was heat treated, riser up, for 40 minutes (except Run 28, which was heat treated for 60 min.). The set point of the furnace was about 923° F. (495° C.).

The workpieces then were quenched to 176° F. (80° C.) in about 12 minutes (or less), removed from the quench unit, and manipulated to remove any remaining loose sand. The loose sand was collected, weighed, and evaluated for appearance. The casting was then rapped (impacted) repeatedly with a hammer to dislodge and remove any core sand that might be remaining in a partially bonded state. Again, the dislodged sand was as collected, weighed, and evaluated for appearance. The results are presented in Table 7.

Table 8 presents additional data for Runs 26-30. When viewed with Table 7, it can be observed that the workpieces with a greater percentage of cleared openings according to the present invention (Table 8) also were able to achieve greater core removal (Table 7).

Additionally, for certain runs, the hardness of each workpiece was measured at one or more locations on each resulting cylinder head. The results are presented in Table 9.

TABLE 7

| Run | Work-piece | Initial wt (lb) (kg) | Loose sand wt (lb) (kg) | Appearance | Rapped sand wt (lb) (kg) | Appearance | Final workpiece wt (lb) (kg) | Nozzle distance (in.) (upper) (lower) | Core wt (lb) (kg) | Core remain (%) | Core removed (%) |
|---|---|---|---|---|---|---|---|---|---|---|---|
| 24 | R | 83.60 | 0.22 | 99% clean | 0.62 | 90% black | 61.95 | 3.13 | 21.65 | 2.86% | 97.14% |
| | | 37.90 | 0.10 | 3 glue lumps | 0.28 | small soft lumps | 28.11 | 2.63 | 9.79 | 2.86% | 97.14% |
| 25 | R | 85.60 | 0.36 | 95% clean | 2.00 | 100% black | 62.35 | 3.13 | 23.25 | 8.60% | 91.40% |
| | | 38.84 | 0.17 | glue lumps | 0.91 | soft to hard lumps | 28.29 | 2.63 | 10.55 | 8.63% | 91.37% |
| 26 | S | 91.90 | 0.30 | 96% clean | 0.08 | 100% black | 61.45 | 3.13 | 30.45 | 0.26% | 99.74% |
| | | 41.68 | 0.14 | | 0.03 | a few med. hard lumps | 27.88 | 2.63 | 13.80 | 0.22% | 99.78% |

TABLE 7-continued

| Run | Work-piece | Initial wt (lb) (kg) | Loose sand wt (lb) (kg) | Appearance | Rapped sand wt (lb) (kg) | Appearance | Final workpiece wt (lb) (kg) | Nozzle distance (in.) (upper) (lower) | Core wt (lb) (kg) | Core remain (%) | Core removed (%) |
|---|---|---|---|---|---|---|---|---|---|---|---|
| 27 | S | 91.70 | 0.32 | 86% clean | 0.16 | 100% black | 61.70 | 3.13 | 30.00 | 0.53% | 99.47% |
| | | 41.60 | 0.14 | | 0.08 | a few very soft hard lumps | 28.00 | 2.00 | 13.60 | 0.59% | 99.41% |
| 28 | S | 91.95 | 0.46 | 98% clean | 0.16 | 55% black | 61.25 | 3.13 | 30.70 | 0.52% | 99.48% |
| | | 41.70 | 0.21 | | 0.07 | a few very soft hard lumps | 27.80 | 2.00 | 13.90 | 0.50% | 99.50% |
| 29 | S | 90.30 | 2.20 | 85% clean | 0.00 | | 60.75 | 3.13 | 29.55 | 0.00% | 100% |
| | | 40.96 | | | 0.00 | | 27.56 | 2.00 | 13.40 | 0.00% | 100% |
| 30 | R | 93.00 | 0.04 | 80% clean | 3.70 | 60% black | 60.80 | 3.13 | 32.20 | 0.01% | 99.99% |
| | | 42.18 | 0.01 | | | | 27.60 | 2.00 | 14.58 | 0.03% | 99.97% |
| 31 | R | 83.90 | 0.38 | 90% clean | 1.92 | 100% black | 62.10 | 3.13 | 21.80 | 8.81% | 91.19% |
| | | 38.06 | 0.17 | | 0.87 | soft to hard lumps | 28.18 | 2.00 | 9.88 | 8.81% | 91.19% |
| 32 | R | 86.05 | 0.20 | 95% clean | 1.80 | 100% black | 61.60 | 3.13 | 24.45 | 7.36% | 92.64% |
| | | 39.04 | 0.09 | | 0.82 | soft lumps | 27.96 | 2.00 | 11.08 | 7.40% | 92.60% |
| 33 | S | 91.45 | 0.30 | 80% clean | 0.86 | 98% black | 61.20 | 3.13 | 30.25 | 2.84% | 97.16% |
| | | 41.48 | 0.13 | | 0.39 | soft-hard lumps | 27.77 | 2.63 | 13.71 | 2.84% | 97.16% |

TABLE 8

| Run | Intake Valves (% open) (% closed) | Exhaust Valves (% open) (% closed) | Inner Water Jackets (6) (% open) (% closed) | Outer Water Jackets (10) (% open) (% closed) | Avg Total (% open) (% closed) | Avg Valve Opening (% open) (% closed) | Avg Water Jackets (% open) (% closed) |
|---|---|---|---|---|---|---|---|
| 26 | 100 | 10 | 16 | 85 | 53 | 55 | 51 |
| | 0 | 90 | 84 | 15 | 47 | 45 | 50 |
| 27 | 100 | 38 | 17 | 100 | 64 | 69 | 59 |
| | 0 | 62 | 83 | 0 | 36 | 31 | 42 |
| 28 | 63 | 25 | 33 | 50 | 43 | 44 | 42 |
| | 37 | 75 | 67 | 50 | 57 | 56 | 59 |
| 29 | 100 | 100 | 100 | 100 | 100 | 100 | 100 |
| | 0 | 0 | 0 | 0 | 0 | 0 | 0 |
| 30 | 100 | 100 | 100 | 100 | 100 | 100 | 100 |
| | 0 | 0 | 0 | 0 | 0 | 0 | 0 |

TABLE 9

Hardness (HBW 10/50 (Brinell Scale 10 mm ball 500 kg load)

| Run | Location 1 | Location 2 | Location 3 | Location 4 | Location 5 | Location 6 |
|---|---|---|---|---|---|---|
| 24 | 92.6 | — | — | — | — | — |
| 25 | 87.0 | 85.7 | — | — | — | — |
| 26 | 79.6 | 96.3 | 91.1 | 89.0 | 92.6 | 89.0 |
| 27 | 96.3 | 96.3 | 96.3 | 96.3 | 96.3 | 96.3 |
| 28 | 92.6 | 96.3 | 96.3 | 96.3 | 100 | 98.6 |
| 29 | 85.7 | 92.6 | 96.3 | 100 | 100 | 96.3 |
| 30 | 89.0 | 100 | 92.6 | 89.0 | 92.6 | 92.6 |
| 31 | 85.7 | — | — | — | — | — |
| 32 | 85.7 | — | — | — | — | — |

Accordingly, it will be readily understood by those persons skilled in the art that, in view of the above detailed description of the invention, the present invention is susceptible of broad utility and application. Many adaptations of the present invention other than those herein described, as well as many variations, modifications, and equivalent arrangements will be apparent from or reasonably suggested by the present invention and the above detailed description thereof, without departing from the substance or scope of the present invention.

While the present invention is described herein in detail in relation to specific aspects, it is to be understood that this detailed description is only illustrative and exemplary of the present invention and is made merely for purposes of providing a full and enabling disclosure of the present invention. The detailed description set forth herein is not intended nor is to be construed to limit the present invention or otherwise to exclude any such other embodiments, adaptations, variations, modifications, and equivalent arrangements of the present invention, the present invention being limited solely by the claims appended hereto and the equivalents thereof.

The invention claimed is:

1. A system for processing a cast metal workpiece, comprising:

a heat treatment station including a furnace through which the workpiece is moved for treatment, the furnace comprising at least one high pressure heating zone having a series of fluid impingement devices adapted to direct a high pressure heated fluid medium at a workpiece within the high pressure heating zone, wherein at least one of the series of fluid impingement devices or the workpiece oscillates at a predetermined interval and across a predetermined range of movement of up to about 36 inches in each direction of oscillation for rapidly heating the workpiece to a temperature for heat treatment of the workpiece for decreasing overall heat treatment time of the workpiece; and a quench station downstream from the heat treatment station.

2. The system of claim 1, further comprising a process control temperature station positioned upstream from the heat treatment station, the process temperature control station including a temperature sensing device in communication with a heat source, wherein the temperature sensing device and the heat source communicate to maintain the temperature of the workpiece at or above a process control temperature for the metal of the workpiece, and wherein the process control temperature is the temperature below which for every one minute of time the temperature of the workpiece decreases, more than one minute of additional heat treatment is required to attain the desired properties of the workpiece.

3. The system of claim 1, the furnace comprising;

a temperature measuring device; and a transfer mechanism in communication with the temperature measuring device, wherein upon detection of a rejection temperature by the temperature measuring device, the transfer mechanism removes the workpiece prior to entry into the furnace.

4. The system of claim 1, further comprising a sand reclamation system including:

a chamber including an inlet, an outlet, and a plurality of baffles defining a circuitous path for the sand therebetween;

a heating element for providing heat to the chamber; and a fluidizing air distributor for urging the sand through the chamber.

5. A method of processing a workpiece, comprising:

pouring a molten metal material into a mold;

solidifying the molten metal material to form a workpiece; and introducing the workpiece into a heat treatment furnace;

after entry of the workpiece into the heat treatment furnace, impinging the workpiece with a high pressure heated fluid medium applied by at least one fluid impingement device at a velocity of at least about 4,000 feet per minute from a distance of less than about 6 inches;

oscillating the at least one of the fluid impingement devices or the workpiece at a programmed interval and across a predetermined range of movement of up to about 36 inches in each direction of oscillation as the heated fluid medium is applied to the workpiece for rapidly heating the workpiece to a temperature for heat treatment of the workpiece for decreasing overall heat treatment time for the workpiece; and heat treating the workpiece.

6. The method of claim 5, further comprising continuously maintaining the formed workpiece at or above a process control temperature prior to impinging the workpiece with the heated fluid medium, where the process control temperature is defined as the temperature below which, for every one minute of time the temperature of the workpiece decreases, more than one minute of additional heat treatment is required to attain the desired properties of the workpiece.

7. The method of claim 5, further comprising at least one of rotating and inverting the workpiece while impinging the workpiece with the heated fluid medium.

8. The method of claim 5, wherein oscillating the at least one fluid impingement device or the workpiece comprises oscillating the at least one fluid impingement device or the workpiece at an interval of up to about 40 feet per minute.

* * * * *